US011058173B2

(12) United States Patent
Cross et al.

(10) Patent No.: US 11,058,173 B2
(45) Date of Patent: Jul. 13, 2021

(54) ARTICLE OF FOOTWEAR WITH AUXETIC SOLE STRUCTURE THAT INCLUDES AGGREGATE

(71) Applicant: NIKE, Inc., Beaverton, OR (US)

(72) Inventors: Tory M. Cross, Portland, OR (US); Bryan N. Farris, North Plains, OR (US); Elizabeth Langvin, Sherwood, OR (US)

(73) Assignee: NIKE, Inc., Beaverton, OR (US)

( * ) Notice: Subject to any disclaimer, the term of this patent is extended or adjusted under 35 U.S.C. 154(b) by 83 days.

(21) Appl. No.: 15/604,884

(22) Filed: May 25, 2017

(65) Prior Publication Data

US 2018/0338573 A1 Nov. 29, 2018

(51) Int. Cl.

| | |
|---|---|
| ***A43B 13/02*** | (2006.01) |
| ***A43B 13/04*** | (2006.01) |
| ***A43B 13/18*** | (2006.01) |
| ***A43B 7/14*** | (2006.01) |
| ***A43B 13/12*** | (2006.01) |
| ***A43B 13/14*** | (2006.01) |
| ***A43B 23/02*** | (2006.01) |

(52) U.S. Cl.

CPC ..... *A43B 13/186* (2013.01); *A43B 7/148* (2013.01); *A43B 13/04* (2013.01); *A43B 13/125* (2013.01); *A43B 13/127* (2013.01); *A43B 13/141* (2013.01); *A43B 13/187* (2013.01); *A43B 13/188* (2013.01); *A43B 23/0245* (2013.01)

(58) Field of Classification Search

CPC ..... A43B 13/125–188

See application file for complete search history.

(56) References Cited

U.S. PATENT DOCUMENTS

| | | | | |
|---|---|---|---|---|
| 4,658,515 A * | 4/1987 | Oatman | A43B 17/14 | 36/2.6 |
| 5,313,717 A * | 5/1994 | Allen | A43B 13/20 | 36/28 |
| 5,392,534 A * | 2/1995 | Grim | A43B 7/147 | 36/154 |
| 6,782,640 B2 * | 8/2004 | Westin | A43B 13/187 | 36/153 |
| 7,140,129 B2 * | 11/2006 | Newson | A43B 5/18 | 36/100 |

(Continued)

FOREIGN PATENT DOCUMENTS

| | | |
|---|---|---|
| CN | 2114314 U | 9/1992 |
| CN | 201005124 Y | 1/2008 |

(Continued)

*Primary Examiner* — Jila M Mohandesi

(74) *Attorney, Agent, or Firm* — Quinn IP Law

(57) ABSTRACT

An article of footwear includes a sole structure with an auxetic structure. The auxetic structure includes an aperture. The sole structure also includes an aggregate that is received in the aperture. The auxetic structure is resiliently deformable between a neutral position and a deformed position. The auxetic structure can move auxetically between the neutral position and the deformed position. The aperture deforms as the auxetic structure moves between the neutral position and the deformed position. The aggregate includes a plurality of particles that support the foot as the auxetic structure deforms between the neutral position and the deformed position.

19 Claims, 13 Drawing Sheets

(56) References Cited

U.S. PATENT DOCUMENTS

| | | | | |
|---|---|---|---|---|
| 7,484,318 | B2 * | 2/2009 | Finkelstein | A43B 13/187 36/153 |
| 7,805,859 | B2 * | 10/2010 | Finkelstein | A43B 13/187 36/153 |
| 7,910,193 | B2 * | 3/2011 | Ma | A47C 23/002 428/218 |
| 7,992,226 | B2 | 8/2011 | Turner | |
| 8,084,117 | B2 * | 12/2011 | Lalvani | B32B 5/18 428/136 |
| 9,078,493 | B2 * | 7/2015 | Bradford | A43B 13/145 |
| 2006/0010717 | A1 * | 1/2006 | Finkelstein | A43B 13/187 36/25 R |
| 2006/0248749 | A1 * | 11/2006 | Ellis | A43B 13/203 36/28 |
| 2008/0196272 | A1 * | 8/2008 | Hay | A43B 7/1415 36/88 |
| 2009/0313853 | A1 * | 12/2009 | Tadin | A43B 3/0005 36/91 |
| 2010/0272969 | A1 | 10/2010 | Taylor | |
| 2011/0277349 | A1 * | 11/2011 | Kim | A43B 3/0005 36/84 |
| 2012/0180335 | A1 * | 7/2012 | Mahoney | A43B 7/144 36/28 |
| 2013/0291409 | A1 * | 11/2013 | Reinhardt | A43B 5/00 36/30 R |
| 2014/0101816 | A1 | 4/2014 | Toronjo | |
| 2014/0109286 | A1 | 4/2014 | Blakely | |
| 2014/0223777 | A1 * | 8/2014 | Whiteman | A43B 13/125 36/102 |
| 2015/0237957 | A1 * | 8/2015 | Cross | A43B 13/14 36/30 R |
| 2015/0245683 | A1 * | 9/2015 | Cross | B32B 27/065 36/103 |
| 2017/0332727 | A1 * | 11/2017 | Beck | A43B 7/146 |
| 2018/0338571 | A1 * | 11/2018 | Cross | A43B 13/04 |

FOREIGN PATENT DOCUMENTS

| | | | |
|---|---|---|---|
| CN | 103181652 | A | 7/2013 |
| CN | 204378063 | U | 6/2015 |
| CN | 106164193 | A | 11/2016 |
| CZ | 355198 | A3 | 6/2000 |
| JP | 2000316606 | A | 11/2000 |
| WO | 9306757 | A1 | 4/1993 |
| WO | 9613994 | A1 | 5/1996 |
| WO | 2016053443 | A1 | 4/2016 |
| WO | 2017053674 | A1 | 3/2017 |

* cited by examiner

ARTICLE OF FOOTWEAR WITH AUXETIC SOLE STRUCTURE THAT INCLUDES AGGREGATE

TECHNICAL FIELD

The following relates to an article of footwear and, more particularly, relates to an article of footwear with an auxetic sole structure that includes an aggregate.

BACKGROUND

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure incorporates an insole, a midsole, and an outsole.

BRIEF DESCRIPTION OF THE DRAWINGS

The present disclosure can be better understood with reference to the following drawings and description. The components in the figures are not necessarily to scale, unless noted herein. Moreover, in the figures, like reference numerals designate corresponding parts throughout the different views.

DETAILED DESCRIPTION

Figure 1:
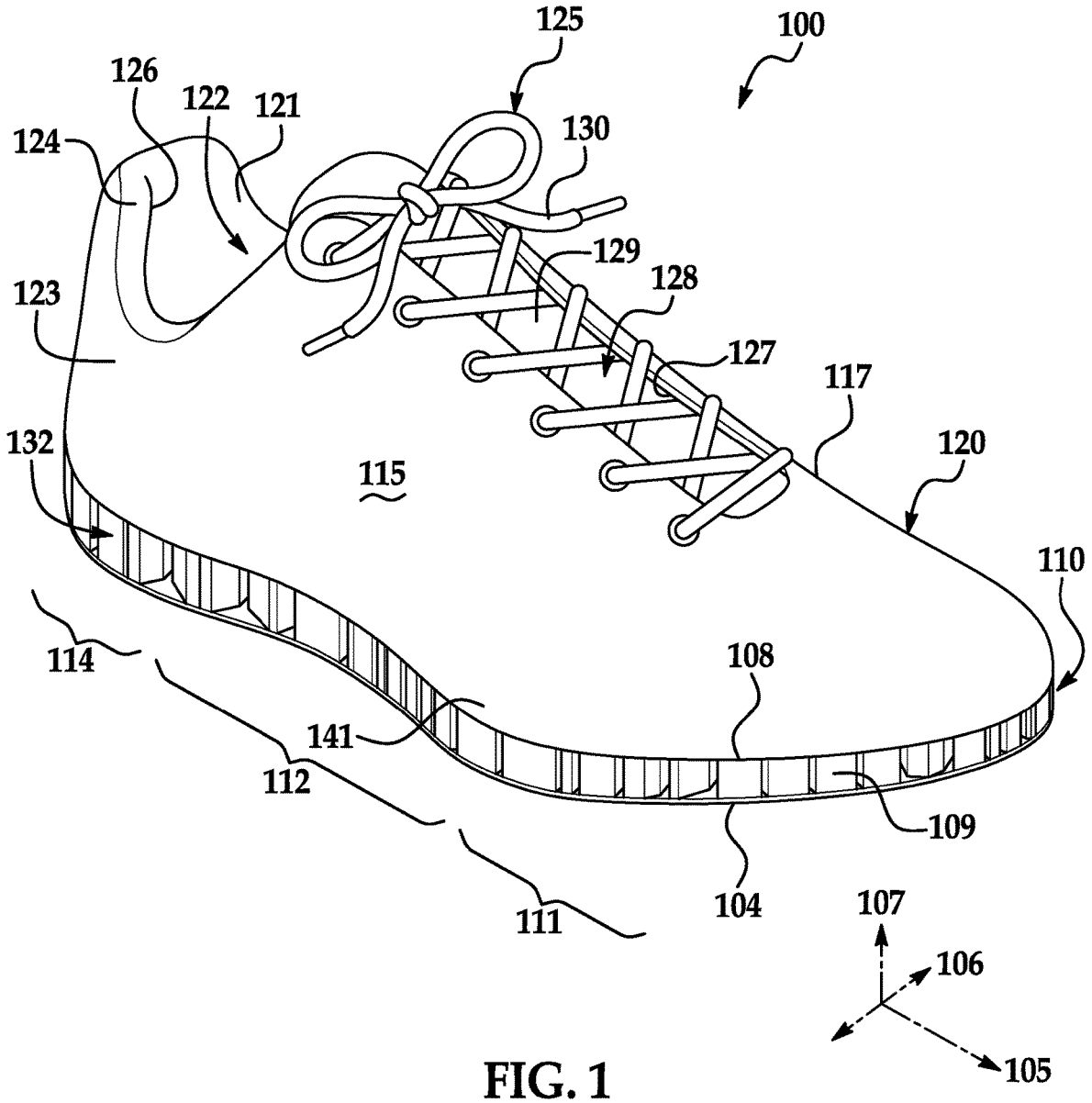
FIG. 1 is an isometric view of an article of footwear according to exemplary embodiments of the present disclosure.

In one aspect, the present disclosure relates to an article of footwear that includes an upper defining a cavity configured to receive a foot. The article of footwear also includes a sole structure that is attached to the upper. The sole structure includes an auxetic structure. The auxetic structure includes an aperture. The sole structure includes an upper member disposed over the auxetic structure and a lower member disposed under the auxetic structure. The sole structure also includes an aggregate that is received in the aperture. The auxetic structure is resiliently deformable between a neutral position and a deformed position. The auxetic structure can deform auxetically between the neutral position and the deformed position. The aperture deforms as the auxetic structure deforms between the neutral position and the deformed position. The aggregate includes a plurality of particles that support the foot as the auxetic structure moves between the neutral position and the deformed position. The article of footwear may be tuned using auxetic structures. With the auxetic structures, the ride, fit, and cushioning across the sole structure can be customized. Such customization is generally not possible when using a monolithic rubber or foam sole. The heel region is configured to absorb energy, while providing lateral stability. The midfoot region can be stiffer than the heel region and/or non-auxetic, because the foot exerts very little contact pressure at the midfoot portion when compared with the heel region. The forefoot region has enough firmness and structure to enable a good/firm push-off without needing to dig out of a mushy cushion.

In one or more aspects, the relative arrangements of the plurality of particles shift as the auxetic structure deforms between the neutral position and the deformed position;

In one or more aspects, the aggregate has a first bulk density when the auxetic structure is in the neutral position;

In one or more aspects, the aggregate has a second bulk density when the auxetic structure is in the deformed position; and In one or more aspects, the second bulk density is greater than the first bulk density.

In one or more aspects, at least some of the plurality of particles tessellate as the auxetic structure moves toward the deformed position.

In one or more aspects, the upper member is elastically stretchable.

In one or more aspects, the lower member is elastically stretchable.

In one or more aspects, at least one of the plurality of particles include a core and a projection that extends from the core.

In one or more aspects, at least one of the plurality of particles includes a rounded surface.

In one or more aspects, at least one of the plurality of particles includes a substantially flat surface.

In one or more aspects, the particles are resilient and compressible.

In one or more aspects, the auxetic structure includes an inner wall that defines the aperture. The aperture includes a first end and a second end. The inner wall extends in a thickness direction from the first end toward the second end. The aperture has a width that is measured between opposing areas of the inner wall. The width is substantially constant in the thickness direction from the first end to the second end.

In one or more aspects, the auxetic structure includes an inner wall that defines the aperture. The aperture includes a first end and a second end. The inner wall extending in a thickness direction from first end toward the second end. The aperture has a width that is measured between opposing areas of the inner wall. The width varies in the thickness direction from the first end to the second end.

In one or more aspects, the sole structure includes a ground-facing surface and a top surface that faces opposite the ground-facing surface. The first end is proximate the ground-facing surface, and the second end is proximate the top surface. The width of the aperture tapers in the first direction from the first end to the second end. The width of the aperture proximate the first end is less than the width of the aperture proximate the second end.

In one or more aspects, the particles of the aggregate are configured to shift relative to each other between a relatively loose position and a comparatively compacted position.

In one or more aspects, the article of footwear, further includes a deformable container that contains the aggregate. The container and the aggregate are both received within the aperture.

In one or more aspects, some of the particles of the aggregate is disposed outside the aperture.

In another aspect, the present disclosure relates to a method of manufacturing an article of footwear. The method includes providing an upper that defines a cavity configured to receive a foot. The method also includes attaching a sole structure to the upper. The sole structure includes an auxetic structure that includes an aperture. The sole structure includes an upper member disposed over the auxetic structure and a lower member disposed under the auxetic structure. The sole structure also includes an aggregate that is received in the aperture. The upper member and the lower member contain the aggregate within the aperture. The auxetic structure is resiliently deformable between a neutral position and a deformed position. The auxetic structure is configured to deform auxetically between the neutral position and the deformed position. The aperture is configured to deform as the auxetic structure moves between the neutral position and the deformed position. The aggregate includes a plurality of particles that are configured to shift and support the foot as the auxetic structure deforms between the neutral position and the deformed position.

In one or more aspects, the method further includes forming the sole structure by: providing the auxetic structure; and introducing the aggregate into the aperture.

In one or more aspects, the method further includes forming the auxetic structure, and filling a majority of a volume of the aperture with the aggregate.

In one or more aspects, the auxetic structure includes an inner wall that defines the aperture. The aperture includes a first end and a second end. The inner wall extending in a thickness direction between the first end and the second end. The aperture has a width that is measured between opposing areas of the inner wall. The width remains substantially constant in the thickness direction from the first end to the second end.

The following relates to an article of footwear with a sole structure that is highly flexible. As such, the sole structure can flex to accommodate movements of the foot, to absorb impact loads, and the like. However, the sole structure can include one or more features that provide support for the wearer's foot. In some embodiments, the sole structure can include a member that deforms under compression and/or that conforms to the wearer's foot. Also, in some embodiments, the sole structure can include an aggregate material. The aggregate can include a plurality of particles that shift to support the wearer's foot and to conform to the wearer's foot. The sole structure can also include features that ensure the aggregate remains in a predetermined position underneath the foot for providing support.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

Referring initially to FIG. 1, an article of footwear 100 is illustrated according to exemplary embodiments. Generally, the footwear 100 can include a sole structure 110 and an upper 120. The upper 120 can receive the wearer's foot and secure the footwear 100 to the wearer's foot whereas the sole structure 110 can extend underneath the upper 120 and support the wearer.

For reference purposes, the footwear 100 may be divided into three general regions: a forefoot region 111, a midfoot region 112, and a heel region 114. The forefoot region 111 can generally include areas of the footwear 100 that correspond with forward portions of the wearer's foot, including the toes and joints connecting the metatarsals with the phalanges. The midfoot region 112 can generally include areas of the footwear 100 that correspond with middle portions of the wearer's foot, including an arch area. The heel region 114 can generally include areas of the footwear 100 that correspond with rear portions of the wearer's foot, including the heel and calcaneus bone. The footwear 100 can also include a lateral side 115 and a medial side 117. The lateral side 115 and the medial side 117 can extend through the forefoot region 111, the midfoot region 112, and the heel region 114 in some embodiments. The lateral side 115 and the medial side 117 can correspond with opposite sides of footwear 100. More particularly, the lateral side 115 can correspond with an outside area of the wearer's foot (i.e. the surface that faces away from the other foot), and the medial side 117 can correspond with an inside area of the wearer's foot (i.e., the surface that faces toward the other foot). The forefoot region 111, midfoot region 112, heel region 114, lateral side 115, and medial side 117 are not intended to demarcate precise areas of footwear 100. Rather, the forefoot region 111, midfoot region 112, heel region 114, lateral side 115, and medial side 117 are intended to represent general areas of footwear 100 to aid in the following discussion.

The footwear 100 can also extend along various directions. For example, as shown in FIG. 1, the footwear 100 can extend along a longitudinal direction 105, a transverse direction 106, and a vertical direction 107. The longitudinal direction 105 can extend generally between the heel region 114 and the forefoot region 111. The transverse direction 106 can extend generally between the lateral side 115 and the medial side 117. Also, the vertical direction 107 can extend generally between the upper 120 and the sole structure 110. It will be appreciated that the longitudinal direction 105, transverse direction 106, and vertical direction 107 are indicated for reference purposes and to aid in the following discussion.

Embodiments of the upper 120 will now be discussed generally with reference to FIG. 1. As shown, the upper 120 can define a void 122 configured to receive a foot of the wearer. The upper 120 can have an interior surface 121 that defines the void 122. The upper 120 can also include an exterior surface 123 that faces opposite the interior surface 121. When the wearer's foot is received within the void 122, the upper 120 can at least partially enclose and encapsulate the wearer's foot. Thus, the upper 120 can extend about the forefoot region 111, lateral side 115, heel region 114, and medial side 117 in some embodiments. Also, in some embodiments, the upper 120 can span at least partly underneath the wearer's foot.

The upper 120 can also include a collar 124. The collar 124 can include a collar opening 126 that is configured to allow passage of the wearer's foot into and out of the void 122.

Furthermore, the upper 120 can include a throat 128. The throat 128 can extend from the collar opening 126 toward the forefoot region 111. In some embodiments, such as the embodiment of FIG. 1, the throat 128 can include a throat opening 127 between the lateral side 115 and the medial side 117. In other embodiments, the throat 128 can be "closed," such that the upper 120 is more sock-like and is substantially continuous and uninterrupted between the lateral side 115 and the medial side 117.

Additionally, the upper 120 can include a closure device 125. In some embodiments, the closure device 125 can be a shoelace 130 that extends between the lateral side 115 and the medial side 117. In other embodiments, the closure device 125 can include a strap, a cable, a buckle, a hook, or other type. By pulling on the closure device 125, the lateral side 115 and the medial side 117 can be drawn toward each other. By loosening the closure device 125, the lateral side 115 and the medial side 117 can move away from each other. Thus, the closure device 125 can be used to adjust the fit of the article of footwear 100.

Moreover, in some embodiments, the footwear 100 can include a tongue 129 within the throat opening 127. The tongue 129 can be attached to an adjacent area of the upper 120, for example, proximate the forefoot region 111. The tongue 129 can also be detached from the lateral side 115 and/or the medial side 117 in some embodiments. The tongue 129 can be disposed between the shoelace 130 and the wearer's foot.

Embodiments of the sole structure 110 will now be discussed generally with reference to FIG. 1. The sole structure 110 can be secured to the upper 120 and can extend between the wearer's foot and the ground when the footwear 100 is worn. Also, the sole structure 110 can include a ground-facing surface 104. The ground-facing surface 104 can also be referred to as a ground-contacting surface. Furthermore, the sole structure 110 can include an upper surface 108 that faces the upper 120. Stated differently, the upper surface 108 can face in an opposite direction from the ground-facing surface 104. The upper surface 108 can be attached to the upper 120. Also, the sole structure 110 can include a side peripheral surface 109 that extends along the vertical direction 107 between the ground-facing surface 104 and the upper surface 108. In some embodiments, the side peripheral surface 109 can also extend substantially continuously about footwear 100 between the forefoot region 111, the lateral side 115, the heel region 114, the medial side 117, and back to the forefoot region 111.

Figure 3:
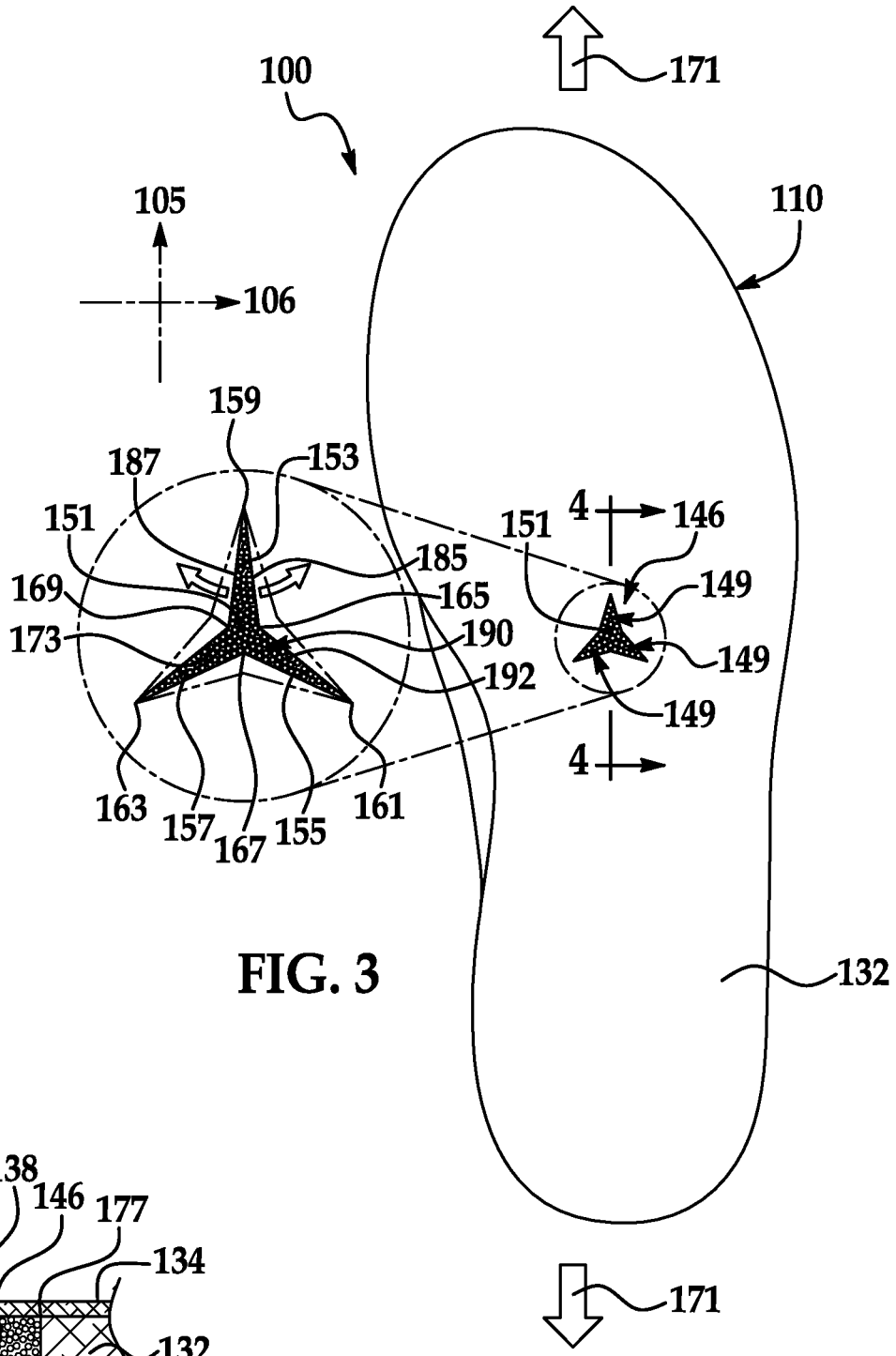
FIG. 3 is a bottom schematic view of the article of footwear of FIG. 1.
Figure 5:
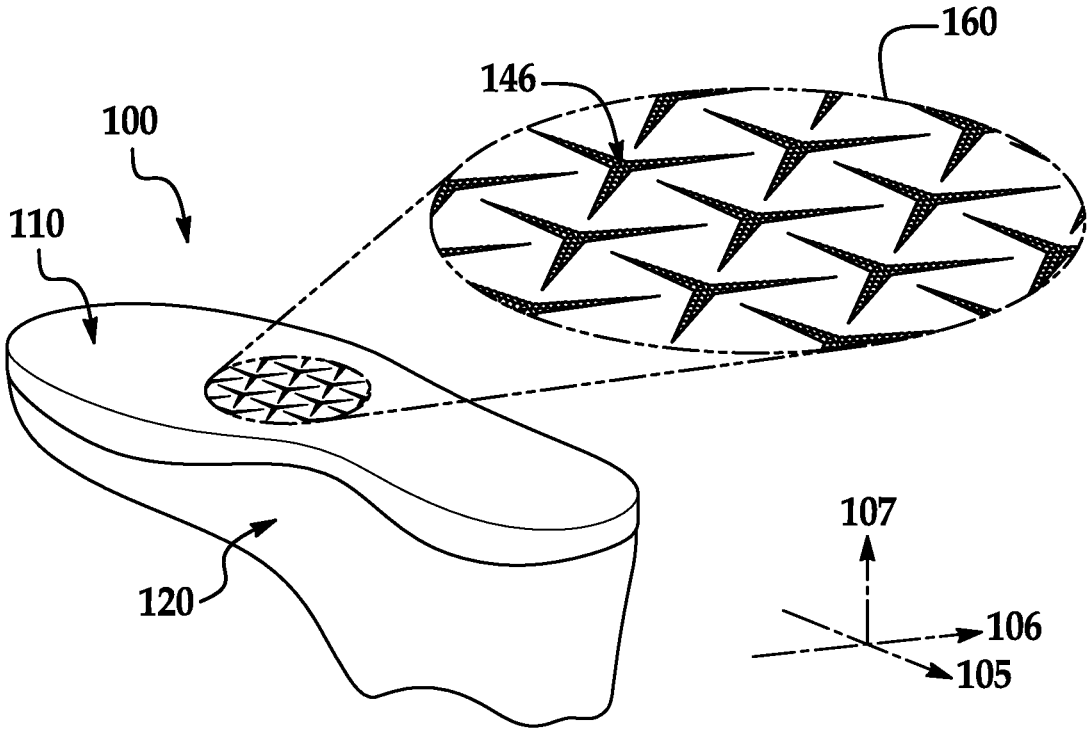
FIG. 5 is an isometric view of the article of footwear of FIG. 1, wherein the sole structure is shown in a neutral position.
Figure 6:
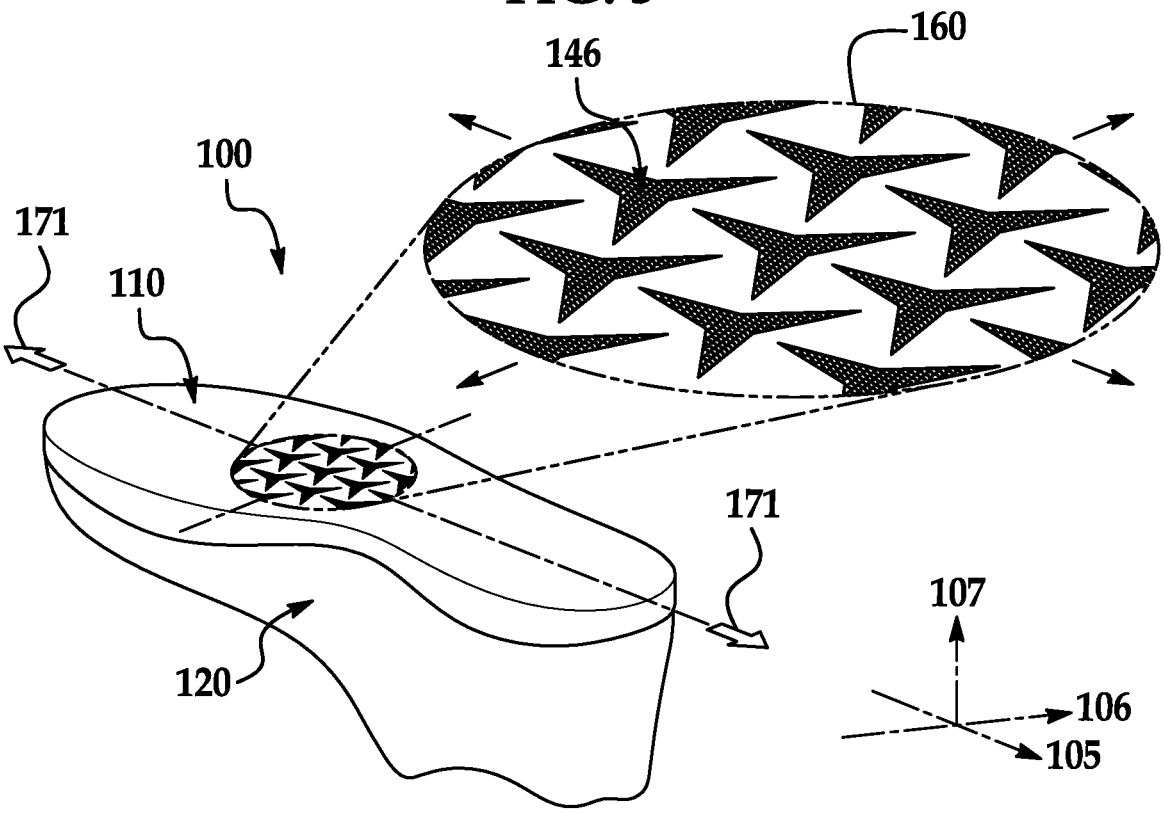
FIG. 6 is an isometric view of the article of footwear of FIG. 1, wherein the sole structure is shown in a deformed position.

In some embodiments, the sole structure 110 can include one or more features that allow it to deform auxetically. As such, the sole structure 110 can be referred to as an auxetic member. The sole structure 110 can also be characterized as having a negative Poisson's ratio. This means that, for example, when the sole structure 110 is stretched in a first direction, the sole structure 110 can elongate in a direction that is orthogonal to the first direction. Specifically, when the sole structure 110 is under tension along the longitudinal direction 105, the sole structure 110 can increase in width along the transverse direction 106. Also, when the sole structure 110 is stretched wider along the transverse direction 106, the sole structure can elongate along the longitudinal direction 105. This behavior is illustrated in the embodiments of FIGS. 3, 5, and 6 and will be discussed in greater detail below.

The sole structure 110 can include one or more features disclosed in U.S. patent application Ser. No. 14/030,002, filed Sep. 18, 2013, published as U.S. Patent Publication Number 2015/0075033, and entitled "Auxetic Structures and Footwear with Soles Having Auxetic Structures", the entire disclosure of which is hereby incorporated by reference.

Figure 2:
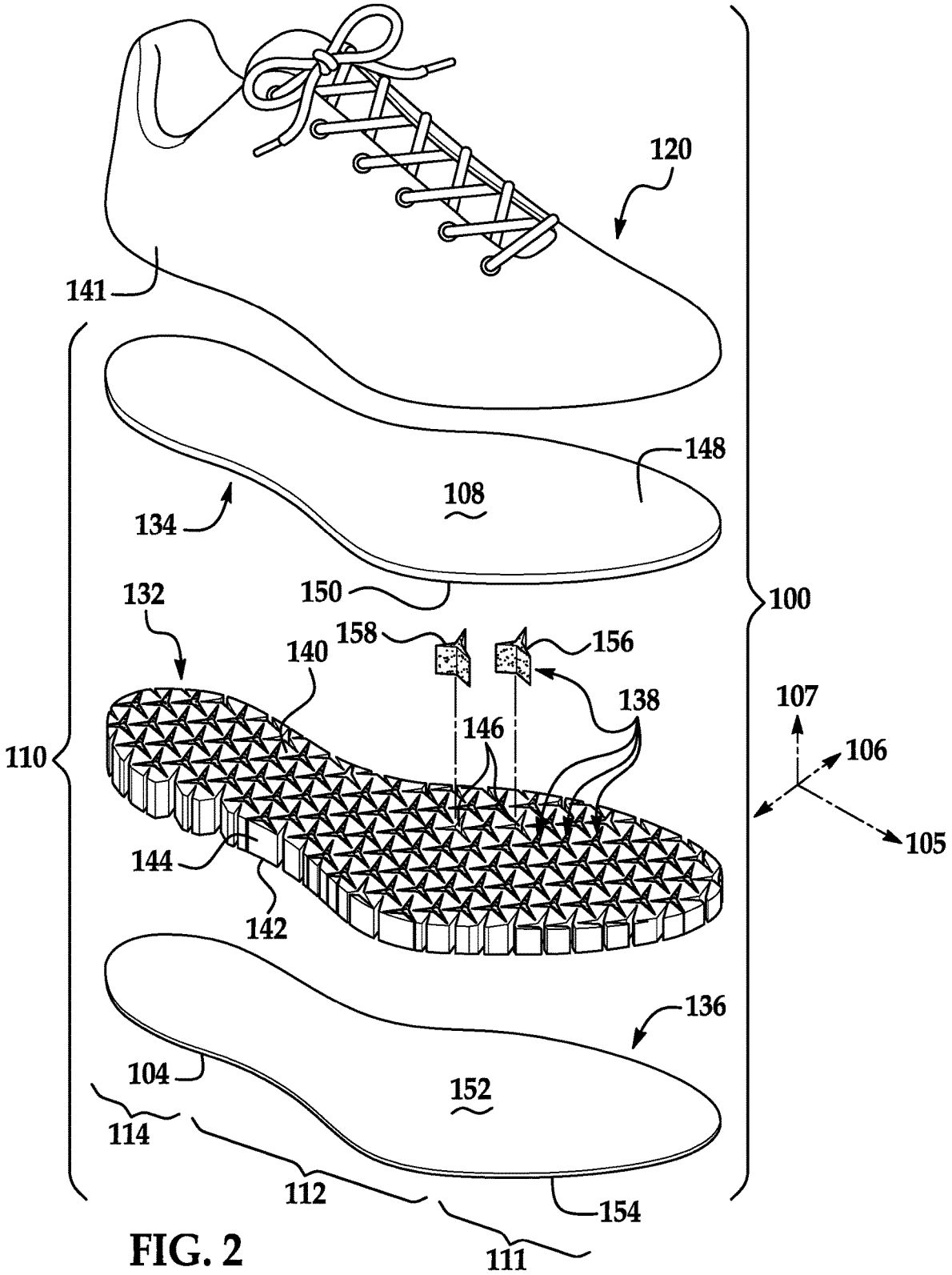
FIG. 2 is an exploded isometric view of the article of footwear of FIG. 1.

As shown in the exploded view of FIG. 2, the sole structure 110 can include a number of components. More specifically, as shown in the exemplary embodiment of FIG. 2, the sole structure 110 can include an auxetic structure 132, an upper member 134, a lower member 136, and one or more support members 138. In FIG. 2, two exemplary support members, identified as a first support member 156 and a second support member 158, are shown exploded from the auxetic structure 132. The remaining support members 138 are shown received by the auxetic structure 132 in FIG. 2.

It will be appreciated that the sole structure 110 can include more or fewer components than the ones illustrated in FIG. 2 without departing from the scope of the present disclosure. Additionally, in some embodiments, these components can be removably attached to each other. In other embodiments, two or more of these components can be integrally attached to define a unitary, one-piece component.

The auxetic structure 132 can include an upper surface 140, which faces the upper 120 of the footwear 100. The auxetic structure 132 can also include a lower surface 142, which faces opposite the upper surface 140. Furthermore, the auxetic structure 132 can include an outer periphery 144, which extends between the upper surface 140 and the lower surface 142 on the periphery of the auxetic structure 132. The auxetic structure 132 can additionally include a plurality of apertures 146. In some embodiments, the apertures 146 can be through-holes that extend through the auxetic structure 132 in the vertical direction 107. Also, the apertures 146 can be open at the upper surface 140 and/or the lower surface 142. In other embodiments, the apertures 146 can be pockets or recesses. For example, the apertures 146 can be recessed downward from the upper surface 140 such that the apertures 146 include a closed bottom end. In additional embodiments, the apertures 146 can be internal cells or voids within the auxetic structure 132 that are closed off at the upper surface 140 and the lower surface 142.

In some embodiments, the auxetic structure 132 can be made from and/or include resilient, elastic material, such as foam, rubber, or another polymeric material. The auxetic structure 132 can be compressible in the vertical direction and can attenuate impact and other loads. Accordingly, the auxetic structure 132 can act as a midsole for the article of footwear 100.

As shown in FIG. 2, the upper member 134 can be a sheet-like member that includes a top surface 148 and an opposing bottom surface 150. The top surface 148 can be attached to the upper 120 of the article of footwear 100. Thus, the top surface 148 can define the upper surface 108 of the sole structure 110. In some embodiments, a lower edge 141 of the upper 120 can be attached to the top surface 148 of the upper member 134. In additional embodiments, the upper 120 can include a strobel or other underfoot member that is layered on and attached to the top surface 148 of the upper member 134. The bottom surface 150 of the member 134 can be layered on and attached to the upper surface 140 of the auxetic structure 132. As such, the upper member 134 can close off the upper ends of the apertures 146 of the auxetic structure 132.

In some embodiments, the upper member 134 of the sole structure 110 can be elastic and resilient. For example, the upper member 134 can be elastically stretchable in the longitudinal direction 105 and the transverse direction 106. As such, the upper member 134 can deform in concert with the auxetic structure 132 as will be discussed.

Additionally, as shown in FIG. 2, the lower member 136 can be a sheet-like member that includes a top surface 152 and an opposing bottom surface 154. The top surface 152 can be layered on and attached to the lower surface 142 of the auxetic structure 132. As such, the lower member 136 can close off the lower ends of the apertures 146 of the auxetic structure 132. The bottom surface 154 can define the ground-facing surface 104 of the sole structure 110.

The lower member 136 can be made from a high-friction material for enhancing traction of the sole structure 110. Also, the lower member 136 can be elastically stretchable in the longitudinal direction 105 and the transverse direction 106. As such, the lower member 136 can deform in concert with the auxetic structure 132 as will be discussed.

Figure 4:
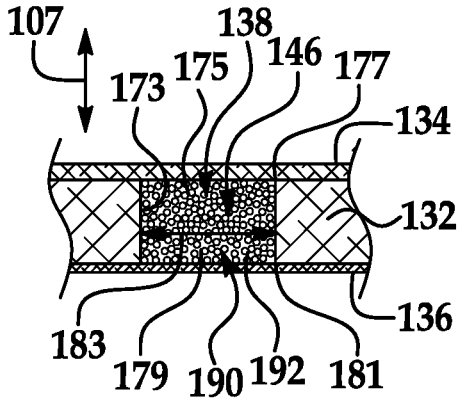
FIG. 4 is a cross section of a sole structure of the article of footwear taken along the line 4-4 of FIG. 3.

Referring now to FIGS. 2-4, the auxetic structure 132 of the sole structure 110 will be discussed in greater detail according to exemplary embodiments. As seen in FIG. 2, the auxetic structure 132 can include apertures 146 disposed within the forefoot region 111, the midfoot region 112, and the heel region 114. In other embodiments, the apertures 146 may be included in only some of these regions.

The apertures 146 can have any suitable geometry and configuration, and the apertures 146 can be disposed in any suitable arrangement in the sole structure 110. The apertures 146 can be shaped such that, when the sole structure 110 is stretched, the apertures 146 deform, allowing for auxetic deformation of the sole structure 110.

An exemplary aperture 146 is shown in detail in FIGS. 3 and 4. The aperture 146 shown in FIG. 3 can be representative of the other apertures of the sole structure 110. As shown in FIG. 3, the aperture 146 can include a plurality of arms 149 that project from a common center 151. The arms 149 can include a first arm 153, a second arm 155, and a third arm 157. The first arm 153 can include a first end 159 that is pointed. Similarly, the second arm 155 can include a second end 161, and the third arm 157 can include a third end 163. The first arm 153 and the second arm 155 can be joined at a first junction 165. The second arm 155 and the third arm 157 can be joined at a second junction 167. The third arm 157 and the first arm 153 can be joined at a third junction 169. With this configuration, the aperture 146 can be referred to as having a so-called "tri-star geometry". In other embodiments, one or more apertures 146 can have other geometries, such as parallelogram-shaped geometries or other polygonal geometries that provide the sole structure 110 with auxetic properties.

Also, an embodiment of the aperture 146 is shown in FIG. 4 in cross section along the vertical direction 107, i.e., through the thickness of the sole structure 110. As shown, the aperture 146 can have a top end 175 that is defined by a top rim 177 and a bottom end 179 that is defined by a bottom rim 181. The aperture 146 can also include an inner wall 173 that extends in the vertical direction 107, between the top end 175 and the bottom end 179. As shown, the upper member 134 can extend across the top rim 177 and close off the top end 175 of the aperture 146. Similarly, the lower member 136 can extend across the bottom rim 181 and close off the bottom end 179 of the aperture 146.

In some embodiments, the aperture 146 can have a width 183, which is measured between opposing areas of the inner wall 173 as shown in FIG. 4. In the embodiment of FIGS. 3 and 4, the width 183 is indicated between end 158 and the junction 169, which oppose each other in the longitudinal direction 105. However, it will be appreciated that the width of the aperture 146 can be measured between other opposing areas of the aperture 146.

As shown in the embodiment of FIG. 4, the width 183 of the aperture 146 can be substantially constant along the vertical direction 107, from the top end 175 to the bottom end 179. Stated differently, the width 183 can be substantially the same at the top rim 177 as at the bottom rim 181 and at intermediate locations along the inner wall 173. In other embodiments, the width 183 can vary between the top end 175 and the bottom end 179. For example, in some embodiments, the width 183 can be greater proximate the top end 175 than at the bottom end 179.

Deformation of the sole structure 110 will now be discussed. FIG. 3 illustrates deformation of the aperture 146 according to some embodiments. This deformation can be a result of a stretching load directed along the longitudinal direction 105, as indicated by arrows 171. A neutral, undeformed position of the aperture 146 is shown in solid lines in FIG. 3, and a deformed position of the aperture 146 is shown in broken lines in FIG. 3 according to exemplary embodiments.

As shown, the inner wall 173 can flex as the aperture 146 moves to the deformed position. For example, a first segment 185 and a second segment 187 of the inner wall 173 can rotate away from each other about the first end 159 as the aperture 146 moves to the deformed position. Thus, the first end 159 can act similar to a hinge. Other segments of the inner wall 173 can flex similarly with the second end 161, third end 163, first junction 165, second junction 167, and/or third junction 169 also acting as hinges. As a result, the aperture 146 can expand in both the longitudinal direction 105 and the transverse direction 106, and the volume of the aperture 146 can increase as the sole structure 110 flexes.

The resiliency of the sole structure 110 can cause the aperture 146 to contract and recover to its neutral position once the stretching loads are reduced. For example, the first segment 185 and the second segment 187 can rotate toward each other about the first end 159 as the aperture 146 recovers to the neutral position. Other segments of the inner wall 173 of the aperture 146 can rotate similarly as the sole structure 110 recovers to its neutral position.

Multiple apertures 146 of the sole structure 110 can deform in the manner illustrated in FIG. 3. Also, the apertures 146 can be arranged on the sole structure 110 in a predetermined pattern that allows the sole structure 110 to deform auxetically. An example of the auxetic expansion is shown in FIGS. 5 and 6. For purposes of illustration, only a region 160 of the sole structure 110 is shown in detail, where region 160 includes a subset of the apertures 146. Specifically, FIG. 5 can represent the neutral, unloaded position, and FIG. 6 can represent the stretched and deformed position.

As tension is applied across the sole structure 110 along an exemplary direction (e.g., along the longitudinal direction 105 as represented by arrows 171 in FIG. 6), the sole structure 110 can undergo auxetic expansion. That is, the sole structure 110 can expand along the longitudinal direction 105, as well as in the transverse direction 106. In FIG. 6, the representative region 160 is seen to expand in both the longitudinal direction 105 and the transverse direction 106 simultaneously as the apertures 146 expand.

Thus, the sole structure 110 can expand as a result of a stretching load as indicated by the arrows 171 in FIG. 6. It will be appreciated that the sole structure 110 can also contract as a result of an applied load. For example, if the direction of the applied load is reversed, then the apertures 146 can contract and the volume of the apertures 146 can reduce. As a result, the sole structure 110 can contract auxetically. Specifically, the length of the sole structure 110 can reduce along the longitudinal direction 105, and the width of the sole structure 110 can reduce along the transverse direction 106. Also, the resiliency of the sole structure 110 can cause the sole structure 110 to recover back to its neutral position once the loads are reduced.

The sole structure 110 can also be compressible, for example, under the weight of the wearer. Compression loads can cause the apertures 146 to deform. For example, compression of the sole structure 110 can cause the apertures 146 to contract in some embodiments. In additional embodiments, the apertures 146 can expand as the sole structure 110 is compressed.

Accordingly, the sole structure 110 can be highly flexible and deformable. As such, the sole structure 110 can flex and support the wearer's foot as the wearer runs, jumps, cuts, or engages in other ambulatory movements.

It will be appreciated that the increased flexibility of the sole structure 110 can affect the support that the sole structure 110 provides to the wearer's foot. For example, the auxetic structure 132 alone may be too compressible to provide adequate support in some cases due to the plurality of apertures 146. Thus, the sole structure 110 can include one or more additional features that enhance the support that the sole structure 110 provides to the wearer's foot.

More specifically, as shown in FIG. 2, the sole structure 110 can include at least one of the support members 138 for these purposes. The support members 138 can be received in respective apertures 146 and can provide needed support at these otherwise empty areas of the sole structure 110. Accordingly, the combination of the auxetic structure 132 and the support members 138 can allow the sole structure 110 to be highly flexible and, yet, effective in supporting the wearer's foot.

Figure 7:
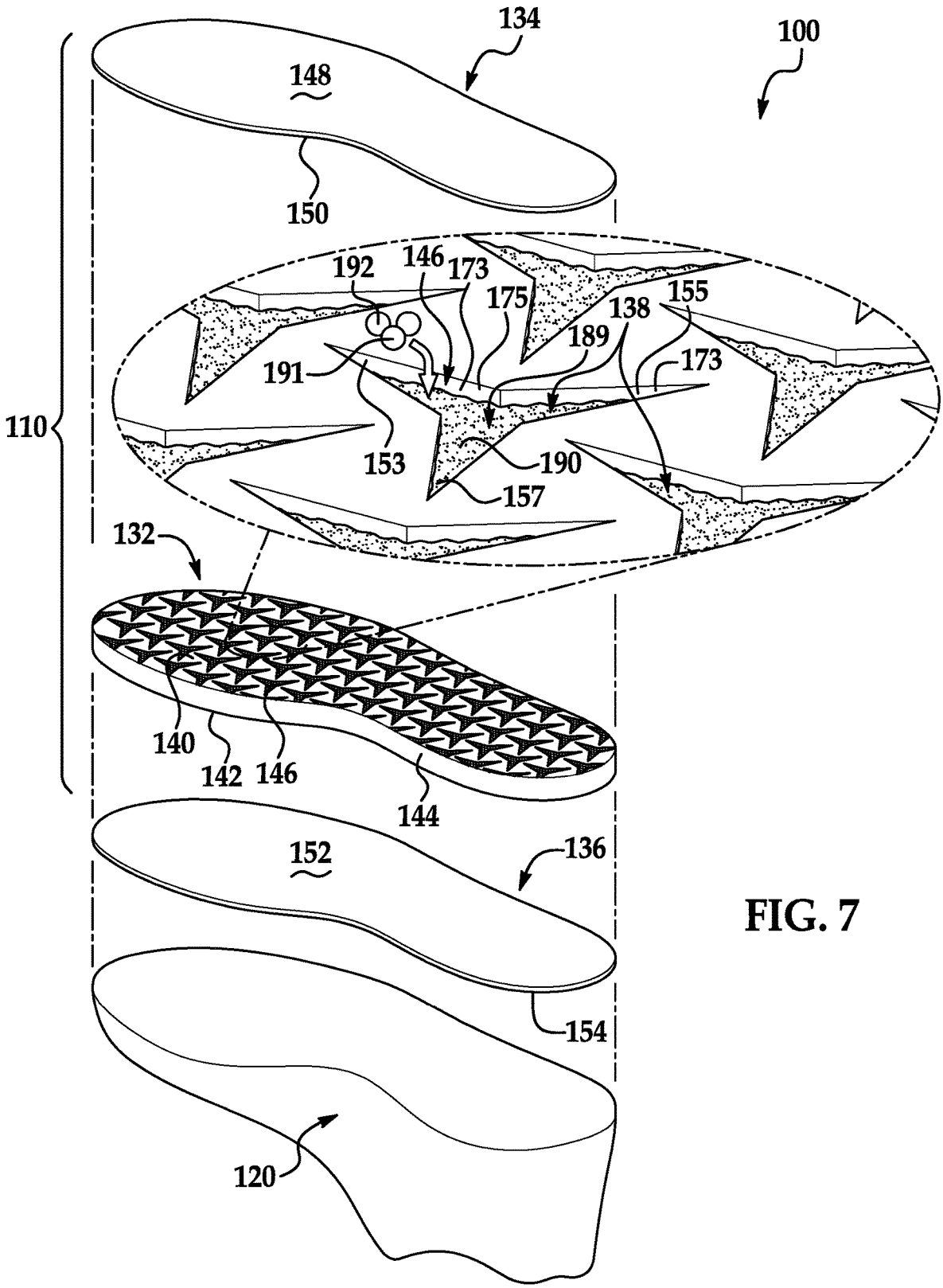
FIG. 7 is an exploded isometric view of a portion of the sole structure of FIG. 1, wherein an aggregate is included according to exemplary embodiments.

Referring now to FIGS. 2 and 7, the support members 138 of the sole structure 110 will be discussed in detail according to exemplary embodiments. The support members 138 of the sole structure 110 can have various configurations. In general, the support members 138 can support the wearer's foot.

In some embodiments, at least one support member 138 can be partly or wholly received in a respective aperture 146 of the auxetic structure 132. As such, the support members 138 can provide support to the wearer's foot in these areas of the sole structure 110.

In some embodiments, the support member 138 can be contained in the aperture 146. In some embodiments, movement of the support member 138 can be limited by the inner wall 173 of the aperture 146 during deformation of the sole structure 110 such that the support member 138 is maintained in a desired position underneath the wearer's foot.

Also, the support members 138 can be deformable in some embodiments. For example, the support members 138 can deform under the weight of the wearer as will be discussed. Also, the support members 138 can deform in concert with other members of the sole structure 110. In some embodiments, the support members 138 can be somewhat compressible in the vertical direction 107 to thereby support the wearer's foot. Also, the support members 138 can conform to the underside of the wearer's foot in some embodiments. As such, the support members 138 can provide comfort and support for the wearer's foot.

Also, movement of the support member 138 can correspond with movement of the auxetic structure 132. In some embodiments, the support member 138 can push outward against the inner wall 173 of the respective aperture 146. This can at least partly cause expansion of the aperture 146 in some embodiments. Moreover, as the aperture 146 contracts, the inner wall 173 of the aperture 146 can push inwards against the support member 138. This can at least partially cause compaction of the support member 138.

As represented in FIG. 7, at least one support member 138 can include an aggregate material. For example, the aggregate material can include a plurality of grains, beads, or other smaller particles. Also, the aggregate material can include sand, polymeric particles, or other material. The particles can have a predetermined shape and/or size, selected to enhance the support provided to the foot. The particles can also have certain characteristics, such as predetermined resiliency and compressibility, for enhancing comfort and support of the foot. Also, the aggregate material can include particles that readily shift or otherwise move relative to each other to move from a relatively loose position to a comparatively compacted position.

The plurality of support members 138 can include a first support member 189, which is indicated in FIG. 7 and which can be representative of other support members 138. The first support member 189 can include an aggregate 190. As shown, the aggregate 190 can comprise a plurality of particles 192. While the aggregate 190 is shown in bulk in FIG. 7, some of the particles 192 are enlarged and separate from the bulk aggregate 190 to show the exemplary embodiment of the particles 192 in more detail.

The particles 192 can have a variety of shapes, geometries, sizes, and other characteristics without departing from the scope of the present disclosure. For example, as shown in the embodiment of FIG. 7, the particles 192 can have an outer surface 191 that is at least partially rounded. In some embodiments, the particles 192 can be spherical, ellipsoidal or otherwise rounded. In other embodiments, the outer surface 191 can include at least one flat surface, an edge, and/or a pointed end. For example, at least one particle 192 can be a polyhedron.

As shown in the embodiment of FIG. 7, the aggregate 190 can include particles 192 with substantially similar shapes. For example, the outer surfaces 191 can be entirely rounded. Specifically, the particles 192 can be substantially spherical in some embodiments. Also, the particles 192 can be substantially equal in size. In other words, the particles 192 can have substantially the same diameter.

Figure 8:
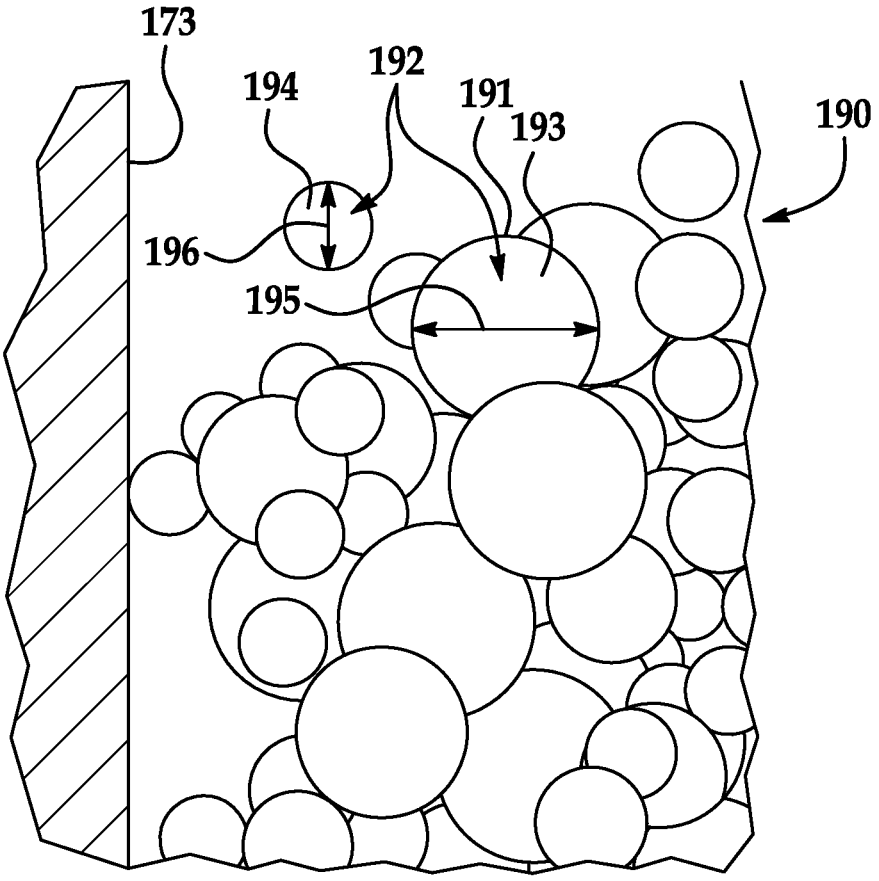
FIG. 8 is a section view of a portion of the sole structure with an aggregate according to additional embodiments of the present disclosure.

FIG. 8 represents another embodiment of the particles 192 of the aggregate 190. As shown, the particles 192 can have different sizes from each other. For example, the particles 192 of FIG. 8 can include a first particle 193 and a second particle 194. The first particle 193 can be larger than the second particle 194. Stated differently, the first particle 193 can have a first diameter 195, the second particle 194 can have a second diameter 196, and the first diameter 195 can be greater than the second diameter 196.

The aggregate 190 can be made from a variety of materials. For example, the aggregate 190 can include sand, dust, powder, beads, granules, or other particulate matter. Additionally, in some embodiments, the material of the aggregate 190 can include polymeric material, a wood-based material, silica, or other material. Furthermore, the particles 192 can be substantially strong for withstanding loading of the sole structure 110. For example, the particles 192 can be strong enough to withstand compressive loads, frictional loads, and other loads occurring during use of the footwear 100.

In some embodiments, the particles 192 of the aggregate 190 can be substantially rigid. As such, the particles 192 can remain the same shape and resist deformation under normal loading.

Figure 9:
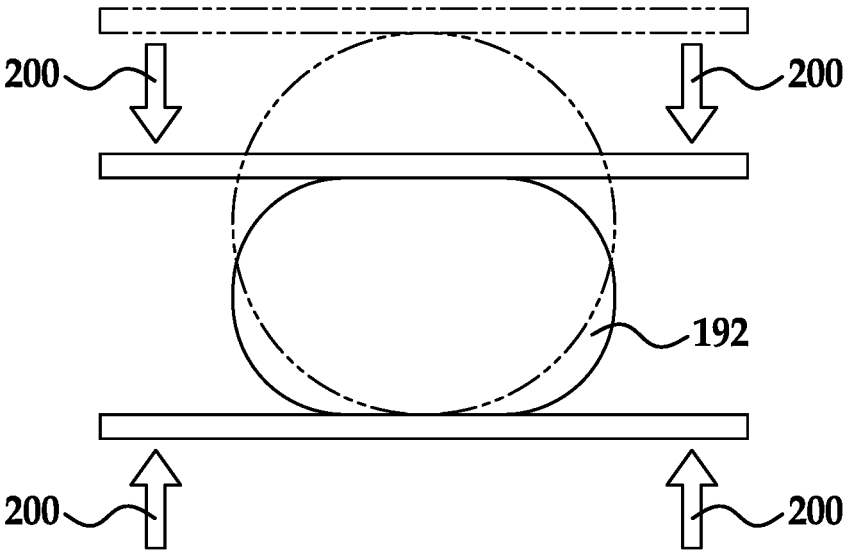
FIG. 9 is a schematic view of a particle of the aggregate shown in compression.

In other embodiments, the particles 192 can be resilient and deformable. For example, as represented in FIG. 9, the particles 192 can be resilient and deformable. Specifically, FIG. 9 schematically shows a representative particle 192 being subjected to a compressive load as represented by arrows 200. When the particle 192 is compressed, the particle 192 can resiliently deform from the spherical, neutral position (shown with broken lines) to the ellipsoidal, deformed position (shown with solid lines). Once the compression load is reduced, then the particle 192 can recover back to the spherical, neutral position. This resilience of the particles 192 can allow the aggregate 190 to provide shock absorption, energy return, and/or cushioning for the wearer's foot.

Figure 10:
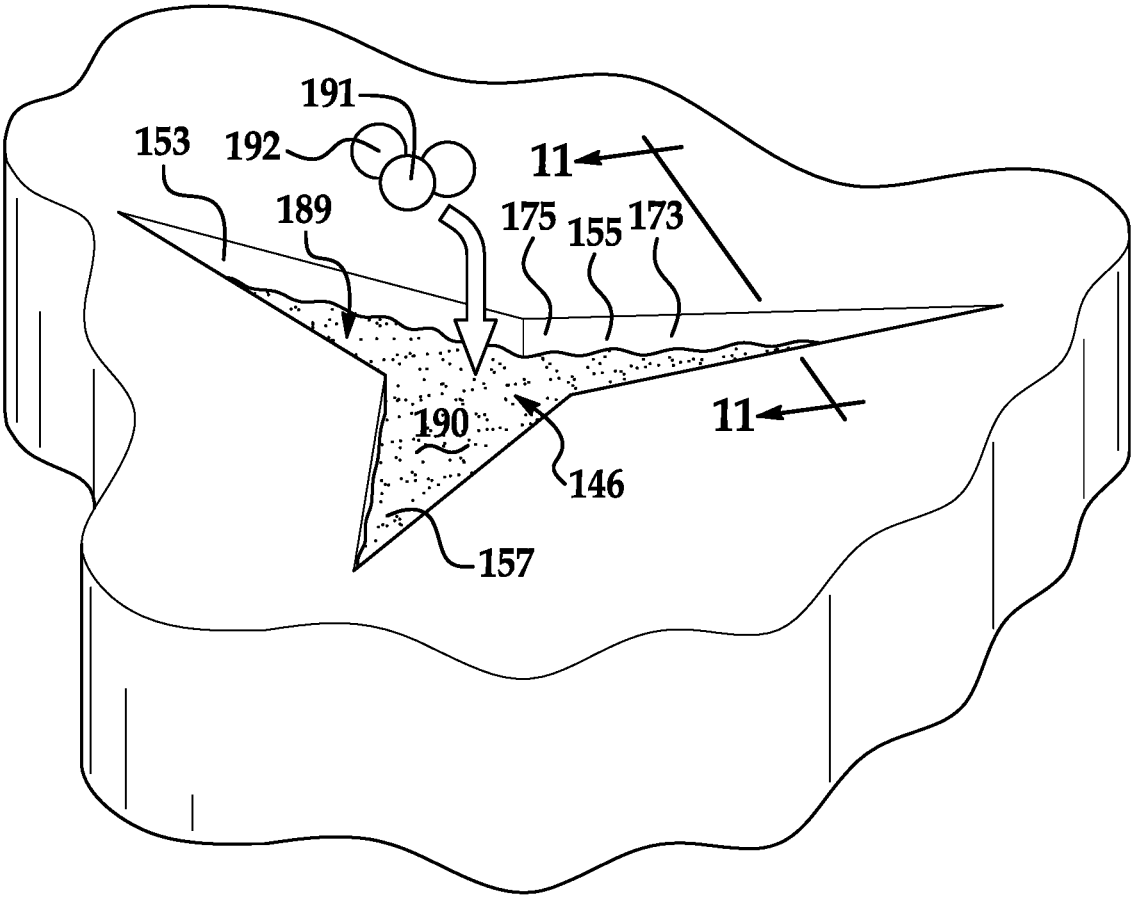
FIG. 10 is an isometric view of an aperture of the sole structure with an aggregate, shown in a neutral position.
Figure 11:
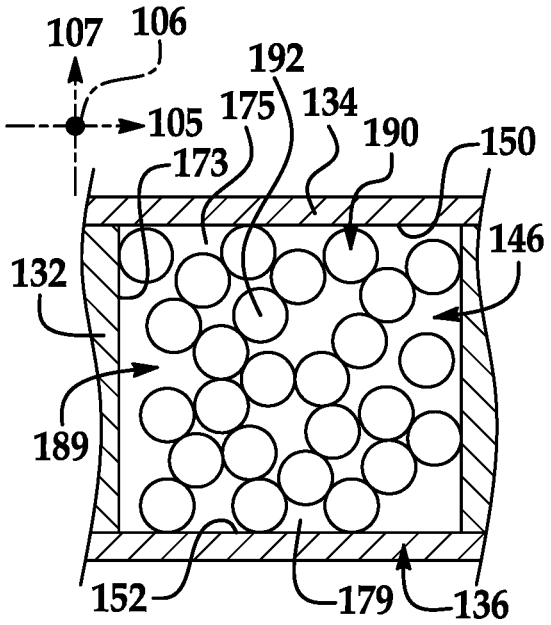
FIG. 11 is a section view of the aperture and aggregate taken along the line 11-11 of FIG. 10.

As shown in FIGS. 7, 10 and 11, at least a portion of the aggregate 190 can be received within the apertures 146 of the auxetic structure 132. Stated differently, at least one aperture 146 can receive at least some of the aggregate 190. In the illustrated embodiments, the apertures 146 receive a corresponding portion of the aggregate 190 of the sole structure 110.

In some embodiments, the aperture 146 can be at least partially filled by the aggregate 190. Specifically, the aggregate 190 can fill the majority of the volume of the apertures 146 in some embodiments. The aggregate 190 can fill the aperture 146 from the top end 175 to the bottom end 179 in some embodiments. Also, the aggregate 190 can fill the first arm 153, the second arm 155, and the third arm 157 of the aperture 146 in some embodiments.

In other embodiments, at least one of the apertures 146 can be partially filled by the aggregate 190. For example, the aperture 146 can be partially filled to allow the aggregate to move more readily during deformation of the sole structure 110. The amount of aggregate 190 within the aperture 146 can be predetermined in some embodiments. For example, more aggregate can be included in some apertures 146 to provide a high degree of support. Less aggregate can be included in other apertures 146 for providing more flexibility and a lesser degree of support for the wearer's foot.

Moreover, in some embodiments, the inner walls 173 of the aperture 146, the upper member 134, and the lower member 136 of the sole structure 110 can contain the aggregate 190 within the apertures 146. Thus, movement of the particles 192 within the aperture 146 can be limited by the inner wall 173, the upper member 134, and/or the lower member 136.

Movement of the particles 192 of the aggregate 190 is illustrated in greater detail in FIGS. 10-15. In these illustrated embodiments, the particles 192 of the aggregate 190 can shift as the sole structure 110 deforms. Stated differently, the relative arrangements of the particles 192 can shift as the auxetic structure 132 moves between the neutral position and the deformed position.

Figure 12:
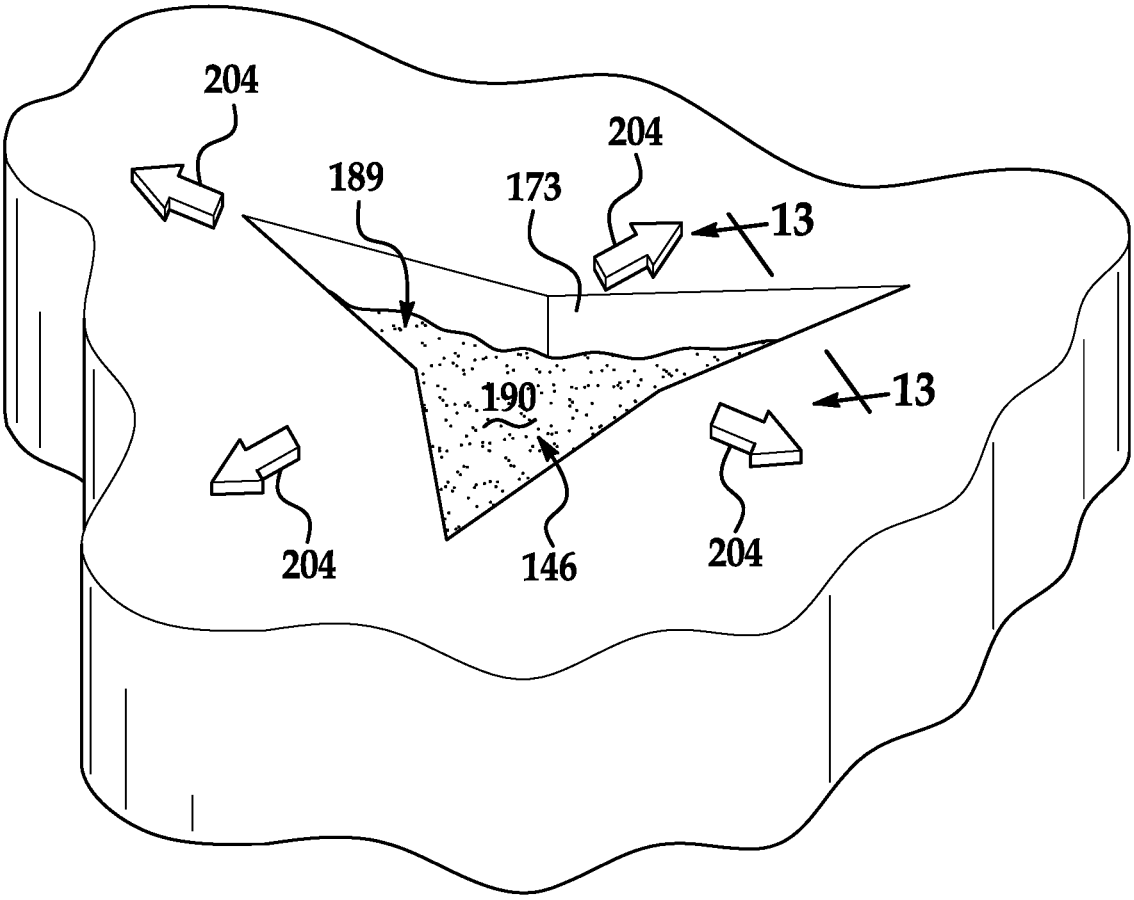
FIG. 12 is an isometric view of the aperture and aggregate of FIG. 10, shown in an expanded, first deformed position.
Figure 13:
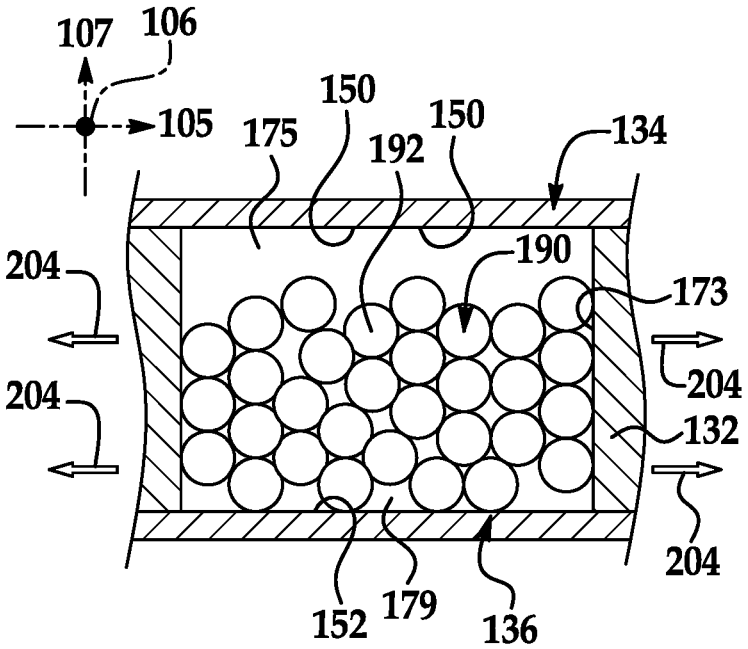
FIG. 13 is a section view of the aperture and aggregate taken along the line 13-13 of FIG. 12.
Figure 14:
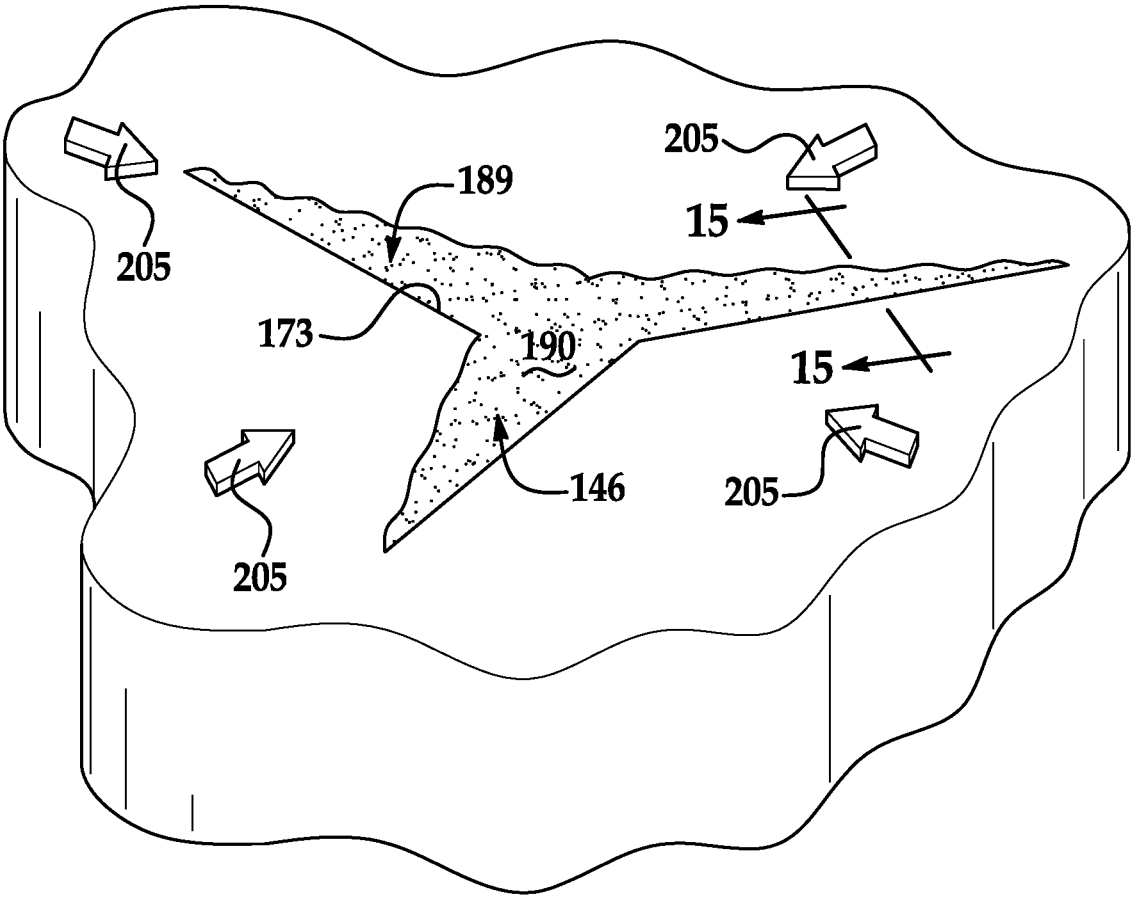
FIG. 14 is an isometric view of the aperture and aggregate of FIG. 10, shown in a contracted, second deformed position.
Figure 15:
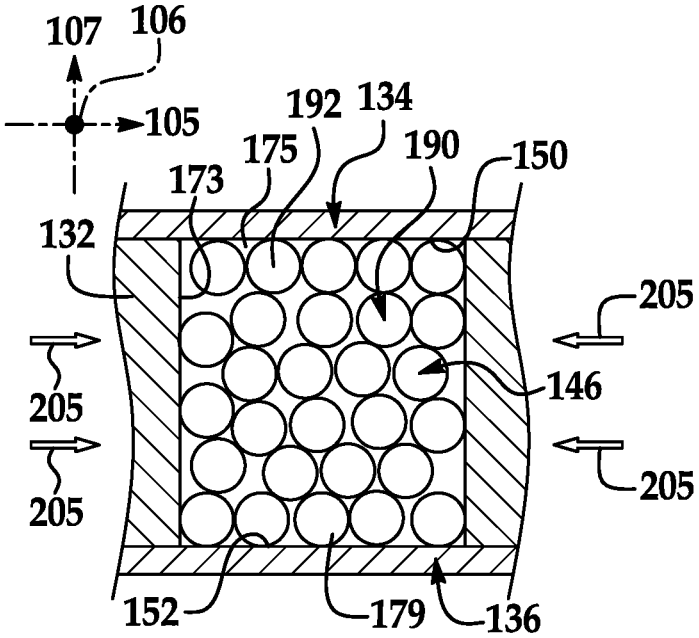
FIG. 15 is a section view of the aperture and aggregate taken along the line 15-15 of FIG. 14.

FIGS. 10 and 11 illustrate an embodiment of the representative aperture 146 and can represent the sole structure 110 at a neutral position. FIGS. 12 and 13 illustrate the aperture 146 at an expanded position as indicated by arrows 204 and can represent the sole structure 110 at a first deformed position. FIGS. 14 and 15 illustrate the aperture 146 at a contracted position as indicated by arrows 205 and can represent the sole structure 110 at a second deformed position. Movement of the particles 192 is illustrated as well in FIGS. 10-15 and will be discussed in detail below.

For example, as the sole structure 110 expands from the neutral position of FIGS. 10 and 11 to the deformed position of FIGS. 12 and 13, at least some of the particles 192 can shift downward in the vertical direction 107 toward the bottom end 179 of the aperture 146. Also, in some embodiments, at least some of the particles 192 can shift outward toward the inner walls 173 of the aperture 146. In some embodiments, the particles 192 can push outward against the inner walls 173, causing expansion of the aperture 146 to some degree. As a whole, the aggregate 190 can also become more densely packed and compacted toward the bottom end 179 of the aperture 146.

In contrast, as the sole structure 110 contracts from the neutral position of FIGS. 10 and 11 to the deformed position of FIGS. 14 and 15, at least some of the particles 192 can shift upward in the vertical direction 107 toward the top end 175 of the aperture 146. Also, in some embodiments, at least some of the particles 192 can shift inward toward the center of the aperture 146. The inner walls 173 can push inward against the aggregate 190, causing compaction of the aggregate 190 to some degree. Thus, the aggregate 190 can become more densely packed and compacted toward the center of the aperture 146, and the top surface of the aggregate 190 can rise within the aperture 146.

In some embodiments, the bulk density of the particles 192 can change as the sole structure 110 flexes and deforms. It will be appreciated that the term "bulk density" can be measured as the total mass of the particles 192 divided by a reference volume in which the particles 192 occupy. Thus, when the sole structure 110 is in the neutral position, the particles 192 can have a first, reduced bulk density represented in FIG. 11. Then, when the sole structure 110 moves to the deformed position, the particles 192 can have a second, increased bulk density represented in FIGS. 13 and 15. As shown, there can be a greater amount of space, gaps, or pores between the particles 192 when in the neutral position of FIG. 11 as compared to the deformed positions of FIGS. 13 and 15, resulting in the difference in bulk density.

When loosely compacted at the first bulk density of FIGS. 10 and 11, the aggregate 190 can provide some support to the foot. However, a relatively high number of particles 192 can be able to shift when the aggregate 190 is in the first bulk density. As the sole structure 110 deforms, the aggregate 190 can shift, absorb energy, and/or conform to the wearer's foot. When packed more densely at the second bulk density of FIGS. 13 and 15, the particles 192 can remain substantially static, allowing forces to transfer readily from particle-to-particle, through the aggregate 190. Thus, the aggregate 190 can behave more like a rigid body for providing sturdier support to the foot.

The sole structure 110 can also resiliently flex back and recover from the deformed position of FIGS. 12-15 to the neutral position of FIGS. 10 and 11. In so doing, the particles 192 can shift back to the more loosely packed first bulk density. Thus, the aggregate 190 can shift cyclically between the different bulk densities.

It will be appreciated that the sole structure 110 can contain the aggregate 190 to ensure that the aggregate 190 remains disposed in a predetermined location. Specifically, the inner walls 173, the bottom surface 150 of the upper member 134, and the top surface 152 of the lower member 136 can cooperate to contain the particles 192 within the aperture 146, despite the shifting of the particles 192. Accordingly, the aggregate 190 can remain generally in its predetermined location for providing support as the sole structure 110 flexes.

Figure 16:
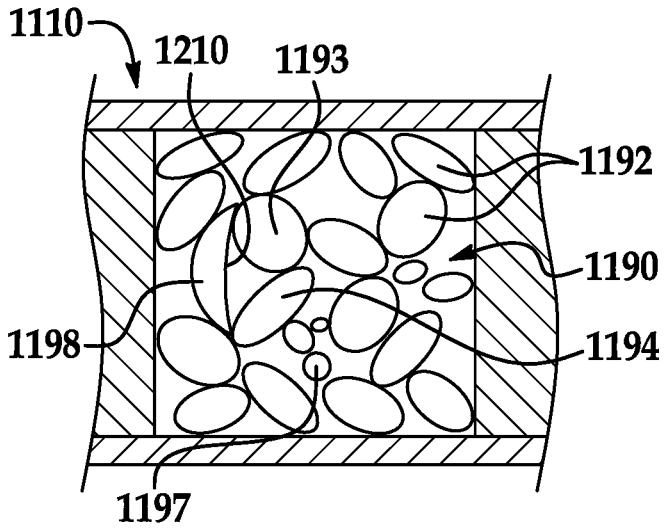
FIG. 16 is a detail view of a portion of the sole structure shown in the neutral position according to additional embodiments of the present disclosure.
Figure 17:
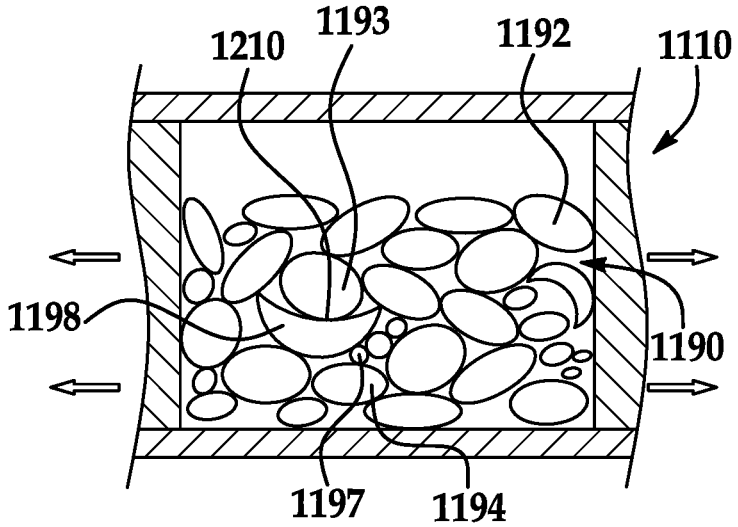
FIG. 17 is a detail view of the portion of the sole structure of FIG. 16 shown in the deformed position.

Referring now to FIGS. 16 and 17, additional embodiments of the present disclosure are illustrated. Components that correspond to those of FIGS. 1-15 are indicated with corresponding reference numbers, increased by 1000. FIG. 16 can correspond to FIG. 11 and can represent the sole structure 1110 in the neutral position. FIG. 17 can correspond to FIG. 13 and can represent the sole structure 1110 stretched, in the deformed position.

As shown, the sole structure 1110 can be substantially similar to the embodiments of FIGS. 11 and 13, except that the particles 1192 of the aggregate 1190 can be different. Specifically, the particles 1192 of the aggregate 1190 can have different shapes and sizes from each other. For example, the particles 1192 can include a first particle 1193, a second particle 1194, a third particle 1197, and a fourth particle 1198. The first particle 1193 and the second particle 1194 can be ellipsoidal, and the first particle 1193 can be larger than the second particle 1194. The third particle 1197 can be spherical and can be smaller than the first particle 1193 and the second particle 1194. Additionally, the fourth particle 1198 can be crescent-shaped. It will be appreciated that the particles 1192 can have other shapes and sizes without departing from the scope of the present disclosure.

The sole structure 1110 can move between the neutral position of FIG. 16 and the deformed position of FIG. 17. In some embodiments, the particles 1192 can be reoriented as the sole structure 1110 moves between these positions. For example, the first particle 1193 and second particle 1194 can rotate during this deformation. Other particles can similarly rotate as the particles 1192 compact together.

Additionally, at least some of the particles 1192 can substantially tessellate together as the sole structure 1110 deforms. More specifically, in some embodiments, when in the neutral position, the first particle 1193 can be spaced apart from the fourth particle 1198. However, when in the deformed position, the first particle 1193 can abut the fourth particle 1198. Also, the first particle 1193 can be received by a concavity 1210 of the fourth particle 1198 when in the deformed position. Thus, the first particle 1193 and the fourth particle 1198 can substantially tessellate. Other particles 1192 can be configured to similarly tessellate as the sole structure 1110 moves toward the deformed position. Also, some particles 1192 can include male-type projections that are configured to be received in female-type receptacles of other particles 1192. Furthermore, the particles can include male-type projections that are received between corresponding female-type spaces defined between adjacent particles 1192. Once tessellated, forces can transfer readily through the particles 1192 of the aggregate 1190. Also, as the sole structure 1110 recovers back to the neutral position, the particles 1192 can untessellate and move away from each other. Thus, the particles 1192 can cyclically tessellate and untessellate in some embodiments.

Figure 18:
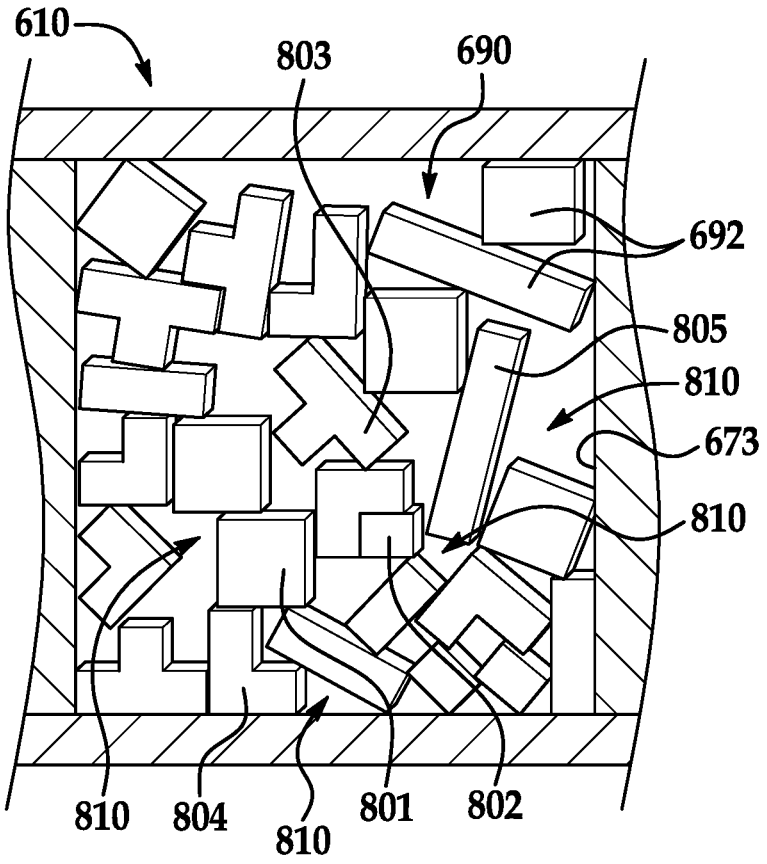
FIG. 18 is a schematic detail view of a portion of the sole structure shown in the neutral position according to additional embodiments of the present disclosure.
Figure 19:
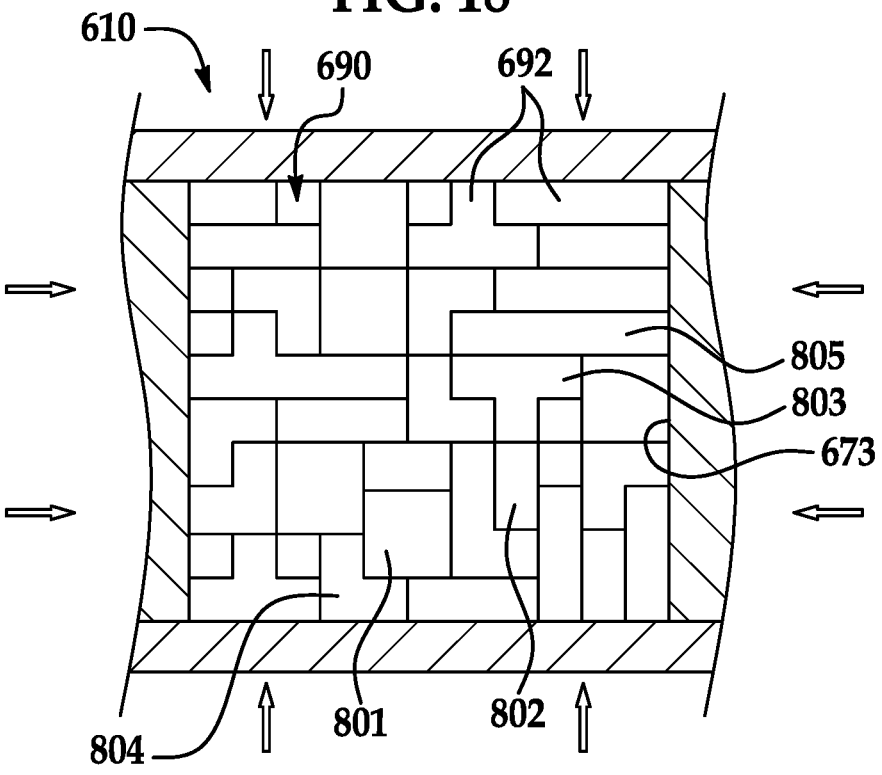
FIG. 19 is a schematic detail view of the portion of the sole structure of FIG. 18 shown in the deformed position.

Referring now to FIGS. 18 and 19, additional embodiments of the present disclosure are illustrated. Components that correspond to those of FIGS. 1-15 are indicated with corresponding reference numbers, increased by 500. FIG. 18 can correspond to FIG. 11 and can represent the sole structure 610 in the neutral position. FIG. 19 can correspond to FIG. 15 and can represent the sole structure 610 compressed, in the deformed position.

As shown, the sole structure 610 can be substantially similar to the embodiments of FIGS. 11 and 15, except that the particles 692 of the aggregate 690 can be different. For example, the particles 692 can be polyhedrons, each with a plurality of planar sides in some embodiments. Specifically, the plurality of particles 692 can include one or more first particles 801, which can be six sided and cube-shaped. The particles 692 can also include one or more second particles 802, which can also be six sided and cube-shaped. However, the second particle 802 can be smaller than the first particle 801. Additionally, the particles 692 can include one or more third particles 803, which can be T-shaped in some embodiments. Furthermore, the particles 692 can include one or more fourth particles 804, which can be generally L-shaped. Also, the particles 692 can include one or more fifth particles 805, which can be six sided and elongate in some embodiments.

When in the neutral position represented in FIG. 18, the particles 692 can be relatively loosely packed. As such, the particles 692 can be spaced apart from each other. Also, relatively large gaps 810 can be present between adjacent particles 692 and/or between the inner wall 673 and the particles 692 when the sole structure 610 is in the neutral position.

In contrast, when the sole structure 610 moves to the deformed position shown in FIG. 19, the particles 692 can shift and reorient. Some of the particles 692 can rotate and others can move linearly. Also, as shown, the particles 692 can tessellate. As such, the size of the gaps 810 represented in FIG. 16 can be reduced. In some embodiments, at least some of the gaps 810 can be eliminated. Also, the side surfaces of adjacent particles 692 can come into planar contact with those of the adjacent particles 692. Specifically, a portion of the first particle 801 can be received by and tessellate with the fourth particle 804 as shown in FIG. 19. Other particles 692 can similarly tessellate with adjacent particles 692. Thus, when tessellated, forces can transfer readily through the aggregate 690. Accordingly, the tessellated aggregate 690 can behave similar to a unitary body.

As explained above, the sole structure 610 can resiliently recover and return back to the neutral position of FIG. 16. As the sole structure 610 recovers, the aggregate 690 can become more loosely compacted and untessellate as represented in FIG. 16.

It will be appreciated that the particles 692 can tessellate in a different manner from those illustrated as the sole structure 610 deforms. In the illustrated embodiment, the majority of the particles 692 tesselate together. However, it will be appreciated that only some of the particles 692 may tessellate in some embodiments.

Figure 20:
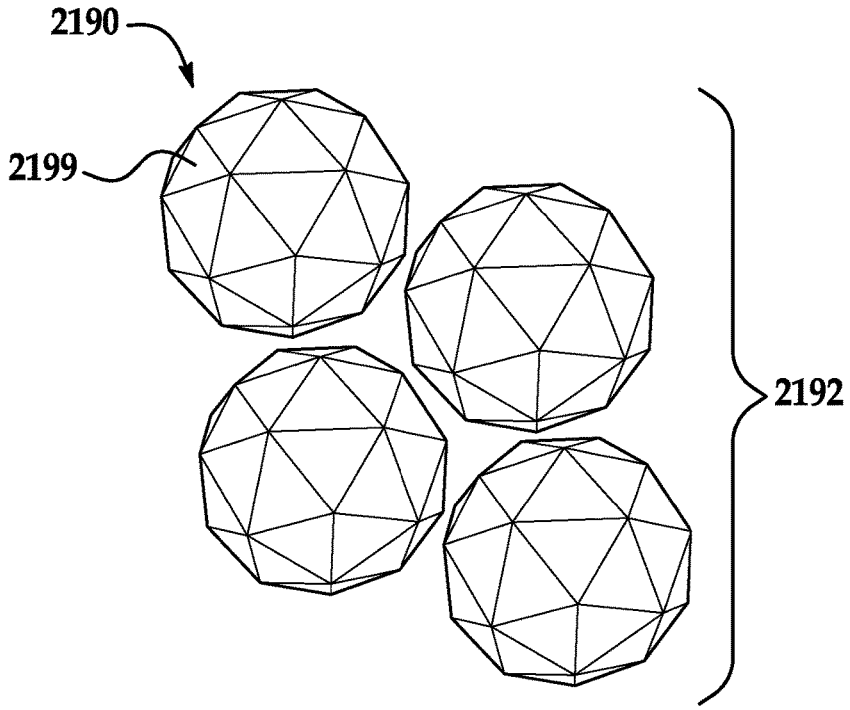
FIG. 20 is an isometric view of particles of the aggregate of the sole structure according to additional embodiments of the present disclosure.

Referring now to FIG. 20, additional embodiments of the aggregate 2190 are illustrated. The aggregate 2190 can be included instead of (or in addition to) the aggregate discussed above and illustrated in FIGS. 1-19.

As shown in FIG. 20, at least one of the particles 2192 can include at least one substantially planar or flat surface 2199. Also, at least one of the particles 2192 can be a polyhedron. Specifically, in the embodiment of FIG. 20, the particles 2192 can be a polyhedron with a plurality of triangular flat surfaces 2199. It will be appreciated that when the particles 2192 are loosely packed (e.g., when the sole structure is in the neutral position), adjacent particles 2192 can be spaced apart from each other. However, when the particles 2192 are compacted (e.g., when the sole structure is in the deformed position), adjacent particles 2192 can abut with corresponding flat surfaces 2199 in planar contact. With the particles 2192 in this position, the aggregate 2190 can provide sturdy support to the wearer's foot.

Figure 21:
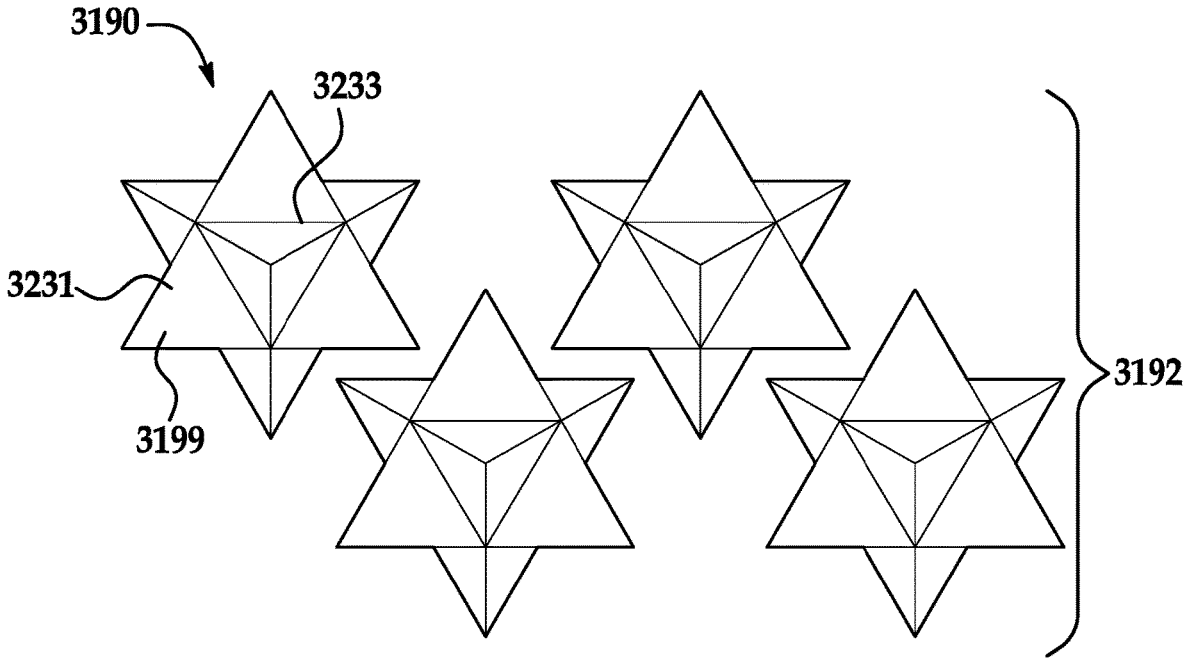
FIG. 21 is an isometric view of particles of the aggregate of the sole structure according to additional embodiments of the present disclosure.

Referring now to FIG. 21, additional embodiments of the aggregate 3190 are illustrated. The aggregate 3190 can be included instead of or in addition to the aggregate discussed above and illustrated in FIGS. 1-20.

As shown in FIG. 21, the particles 3192 can include a core 3233 and at least one projection 3231 that projects from the core 3233. Specifically, as shown in the embodiment of FIG. 21, the projections 3231 can include triangular flat surfaces 3199 such that the projections 3231 can be pyramid-shaped. It will be appreciated that the projections 3231 can be received between other particles 3192 as the particles 3192 become more tightly compacted for providing sturdy support to the wearer's foot. Also, in some embodiments, the particles 3192 can tessellate together as the particles 3192 compact together.

Figure 22:
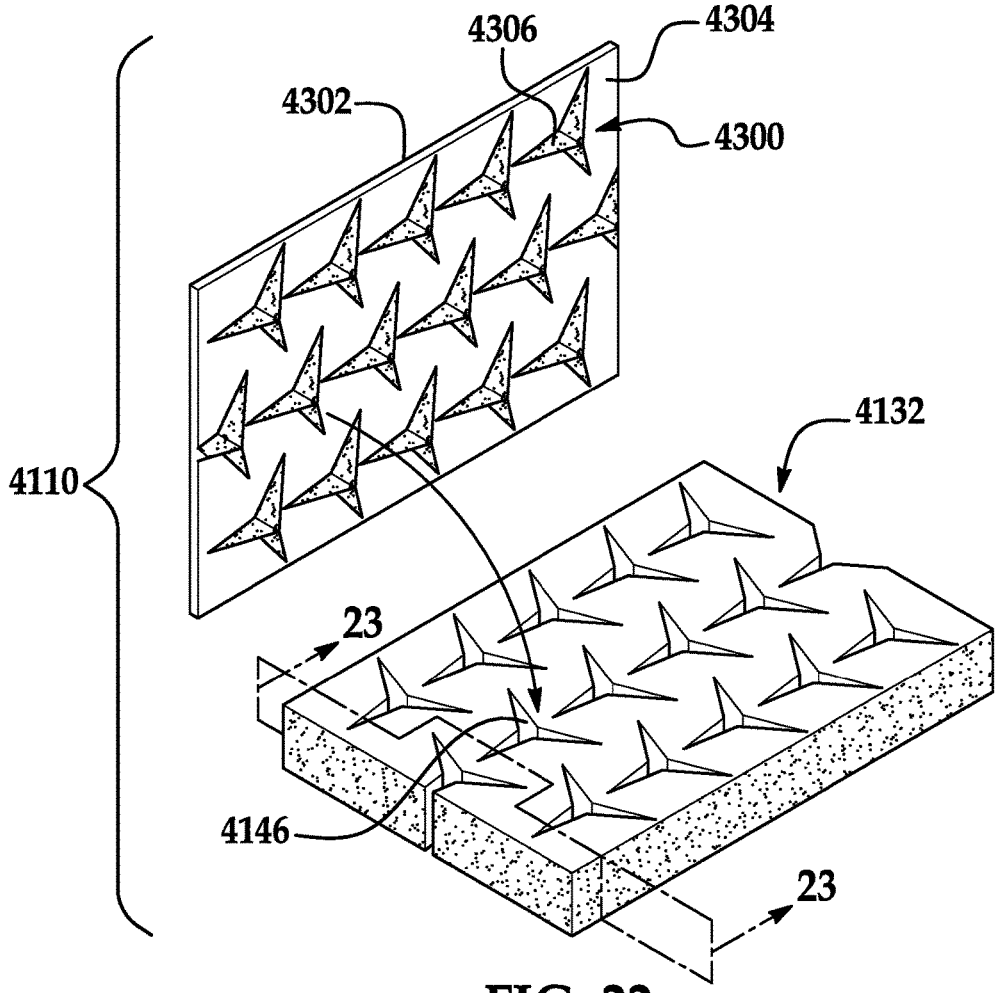
FIG. 22 is an exploded isometric view of the sole structure according to additional embodiments of the present disclosure.
Figure 23:
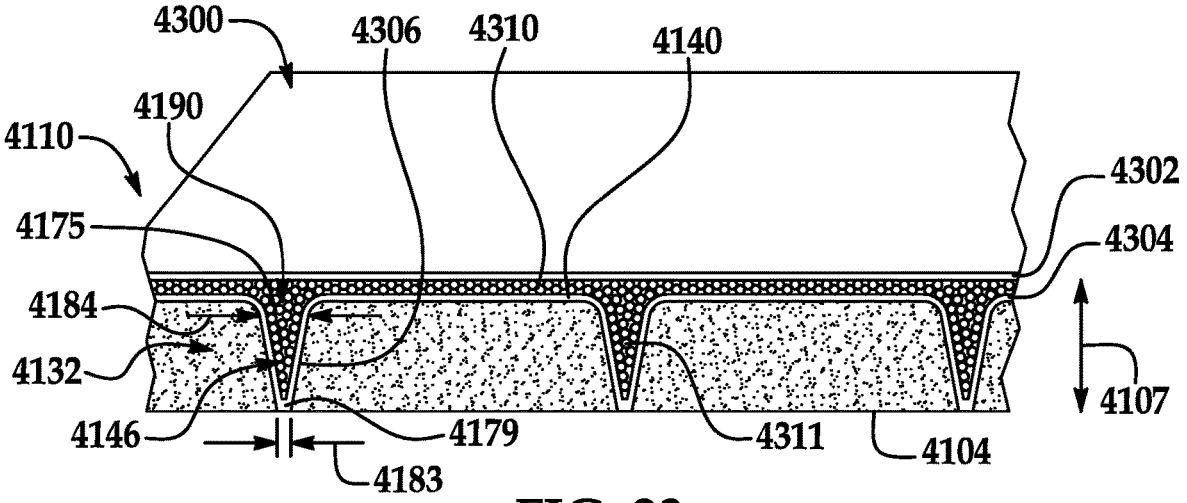
FIG. 23 is a section view of the sole structure, taken along the line 23-23 of FIG. 22.

Referring now to FIGS. 22-23, additional embodiments of the sole structure 4110 are illustrated according to exemplary embodiments. For purposes of clarity, only a localized portion of the sole structure 4110 is shown instead of the entire sole structure 4110. Also, components that correspond to the embodiments of FIGS. 1-15 are indicated with corresponding reference numbers increased by 4000.

As shown in the exploded view of FIG. 22, the sole structure 4110 can include the auxetic structure 4132 similar to the embodiments discussed above. However, as shown in FIG. 23, the width of at least one aperture 4146 can vary in the thickness direction 4107 between the top end 4175 and the bottom end 4179 of the aperture 4146. In some embodiments, the width of the aperture 4146 can taper gradually between the top end 4175 and the bottom end 4179. Specifically, as shown in FIG. 23, the width 4183 at the bottom end 4179, proximate the ground-facing surface 4104, can be less than the width 4184 at the top end 4175 of the aperture 4146.

Additionally, as shown in FIGS. 22 and 23, the aggregate 4190 can be contained in a container 4300. The container 4300 can include a top membrane 4302 and a bottom membrane 4304, and the aggregate 4190 can be disposed between the membranes 4302, 4304 as shown in FIG. 23. The container 4300 can also be flexible, deformable, and resilient so as flex in concert with the auxetic structure 4132.

In some embodiments, the top membrane 4302 can be sheet-like and substantially flat and smooth. In contrast, the bottom membrane 4304 can include projections 4306 that correspond in shape to the apertures 4146 of the auxetic structure 4132. The projections 4306 can be received in corresponding ones of the apertures 4146.

The aggregate 4190 can be disposed within the container 4300, between the top membrane 4302 and the bottom membrane 4304. In some embodiments, at least some of the aggregate 4190 can be disposed within the projections 4306 so as to be received within the apertures 4146 of the auxetic structure 4132. Also, in some embodiments, at least some of the aggregate 4190 can be disposed within the container 4300, but outside the apertures 4146. More specifically, as shown in FIG. 23, an upper portion 4310 of the aggregate 4190 can be layered over the upper surface 4140 of the auxetic structure 4132, and a lower portion 4311 of the aggregate 4190 can be received within the projections 4306, within the apertures 4146.

Accordingly, the wearer's foot can be supported atop a substantially continuous layer of the aggregate 4190. Also, the aggregate 4190 within the apertures 4146 can provide support as the auxetic structure 4132 flexes and deforms as discussed in detail above. Moreover, the aggregate 4190 can compact and/or tessellate readily due to the tapered width of the apertures 4146. Furthermore, the container 4300 can contain the aggregate 4190 such that the aggregate 4190 remains disposed in the predetermined location in the sole structure 4110.

The article of footwear of the present disclosure can be manufactured in various ways without departing from the scope of the present disclosure. By way of example, these methods will be discussed primarily in relation to the embodiments of FIGS. 1-15. It will be understood, however, that these methods can be employed for manufacturing the other embodiments of the footwear.

The upper 120 can be formed and provided in various ways. For example, multiple pieces can be joined via adhesives, stitching, or other methods to form the upper 120. The sole structure 110 can be formed separately in some embodiments. For example, the auxetic structure 132 can be formed, for example, by a molding process. Once formed, the lower member 136 can be attached to the auxetic structure 132, for example, via adhesives. Next, the aggregate 190 can be introduced into the apertures 146 of the auxetic structure 132 as discussed above. Subsequently, the upper member 134 of the sole structure 110 can be attached to the auxetic structure 132 to contain the aggregate 190 within the apertures 146. Finally, the sole structure 110 can be attached to the upper 120.

While various embodiments of the present disclosure have been described, the description is intended to be exemplary, rather than limiting and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims.

What is claimed is:

1. An article of footwear comprising:

an upper defining a cavity, wherein the cavity is configured to receive a foot; and a sole structure attached to the upper, wherein the sole structure includes:

a midsole including a plurality of through-hole apertures extending between an upper surface of the midsole and a lower surface of the midsole, and wherein the midsole is an auxetic structure, and the midsole includes a plurality of inner walls each defining one of the plurality of through-hole apertures; and an upper member in contact with the upper surface of the midsole and extending across each of the plurality of apertures;

a lower member in contact with the lower surface of the midsole and extending across each of the plurality of apertures;

an aggregate that is received in the each of plurality of apertures, wherein the upper member and the lower member contain the aggregate within the each of plurality of apertures;

wherein the auxetic structure is resiliently deformable between a neutral position and at least one deformed position;

wherein the auxetic structure is configured to deform auxetically between the neutral position and the at least one deformed position;

wherein each of the plurality of apertures deforms as the auxetic structure deforms between the neutral position and the at least one deformed position; and wherein the aggregate includes a plurality of particles configured to support the foot as the auxetic structure deforms between the neutral position and the at least one deformed position;

wherein the relative arrangements of the plurality of particles shift as the auxetic structure deforms between the neutral position and the at least one deformed position;

wherein the particles are loosely packed when the auxetic structure is in the neutral position so that at least two adjacent particles are spaced apart from each other when the auxetic structure is in the neutral position;

wherein at least one of the plurality of particles is in direct contact with the upper member when the auxetic structure is in the neutral position;

wherein the at least one deformed position includes a first deformed position and a second deformed position;

wherein each of the plurality of particles is spaced apart from the upper member so as to define a void between the upper member and each of the plurality of particles when the auxetic structure is in the first deformed state; and wherein the at least one of the plurality of particles is in direct contact with the upper member when the auxetic structure is in the second deformed state.

2. The article of footwear of claim 1, wherein the aggregate has a first bulk density when the auxetic structure is in the neutral position;

wherein the aggregate has a second bulk density when the auxetic structure is in the at least one deformed position; and wherein the second bulk density is greater than the first bulk density.

3. The article of footwear of claim 2, wherein at least some of the plurality of particles tessellate as the auxetic structure moves toward the at least one deformed position.

4. The article of footwear of claim 1, wherein the lower member is configured to deform in concert with the auxetic structure.

5. The article of footwear of claim 1, wherein the upper member is configured to deform in concert with the auxetic structure.

6. The article of footwear of claim 1, wherein at least one of the plurality of particles include a core and a projection that extends from the core.

7. The article of footwear of claim 1, wherein the upper member is elastically stretchable.

8. The article of footwear of claim 1, wherein the lower member is elastically stretchable.

9. The article of footwear of claim 1, wherein the plurality of particles are resilient and compressible, each of the plurality of apertures is defined by an inner wall of the midsole, and the inner wall is an integral part of the auxetic structure such that the inner wall and the auxetic structure form a one-piece structure, at least one of the plurality of particles is in direct contact with the inner wall and the lower member, the upper member is in direct contact with the upper surface of the midsole, the lower member is in direct contact with the lower surface of the midsole, the upper member is discrete from the midsole, the lower member is discrete from the midsole, and each of the lower member and the upper member is a single sheet.

10. The article of footwear of claim 1, wherein the aperture has a width that is measured between opposing areas of the inner wall; and wherein the width is substantially constant in the thickness direction from the first end to the second end.

11. The article of footwear of claim 1, wherein the auxetic structure includes an inner wall that defines the aperture, wherein the aperture includes a first end and a second end, the inner wall extending in a thickness direction from first end toward the second end;

wherein the aperture has a width that is measured between opposing areas of the inner wall; and wherein the width varies in the thickness direction from the first end to the second end.

12. The article of footwear of claim 11, wherein the sole structure includes a ground-facing surface and a top surface that faces opposite the ground-facing surface;

wherein the first end is proximate the ground-facing surface, and wherein the second end is proximate the top surface;

wherein the width of the aperture tapers in the first direction from the first end to the second end.

13. The article of footwear of claim 12, wherein the width of the aperture proximate the first end is less than the width of the aperture proximate the second end.

14. The article of footwear of claim 1, wherein the plurality of particles of the aggregate is configured to shift relative to each other between a relatively loose position and a comparatively compacted position.

15. The article of footwear of claim 1, further comprising a deformable container that contains the aggregate; and wherein the container and the aggregate are both received within the aperture.

16. The article of footwear of claim 1, wherein some of the plurality of particles of the aggregate is disposed outside the aperture.

17. The article of footwear of claim 1, wherein each of the plurality of particles has a same size.

18. The article of footwear of claim 1, wherein the plurality of particles includes a first particle and a second particle, the first particle has a first diameter, the second particle has a second diameter, and the first diameter is greater than the second diameter.

19. The article of footwear of claim 1, wherein the plurality of particle includes sand.

* * * * *